US011203865B2

(12) United States Patent
Hanson

(10) Patent No.: US 11,203,865 B2
(45) Date of Patent: Dec. 21, 2021

(54) BEAM AND BOLTING CONSTRUCTION SYSTEM AND METHOD

(71) Applicant: Stephen Hanson, Ben Lomond, CA (US)

(72) Inventor: Stephen Hanson, Ben Lomond, CA (US)

(73) Assignee: REDRIDER, LLC, San Jose, CA (US)

( * ) Notice: Subject to any disclaimer, the term of this patent is extended or adjusted under 35 U.S.C. 154(b) by 0 days.

(21) Appl. No.: 17/165,747

(22) Filed: Feb. 2, 2021

(65) Prior Publication Data

US 2021/0156144 A1 May 27, 2021

Related U.S. Application Data

(63) Continuation-in-part of application No. 17/095,181, filed on Nov. 11, 2020, which is a continuation of (Continued)

(51) Int. Cl.
*E04B 2/70* (2006.01)
*E04B 2/06* (2006.01)
(Continued)

(52) U.S. Cl.
CPC ..... *E04B 2/702* (2013.01); *E04B 2/06* (2013.01); *E04B 2/704* (2013.01); *E04B 2001/3583* (2013.01); *E04B 2002/0254* (2013.01)

(58) Field of Classification Search
CPC . E04B 2/06; E04B 2/702; E04B 2/704; E04B 2001/3583; E04B 2001/0254
See application file for complete search history.

(56) References Cited

U.S. PATENT DOCUMENTS 729,408 A * 5/1903 Pickin ..... E04B 1/06 52/223.7
2,563,703 A * 8/1951 Bonney ..... E04B 2/702 52/233
(Continued)

FOREIGN PATENT DOCUMENTS

WO 9109513 A2 7/1991

OTHER PUBLICATIONS

International Search Report for PCT/US2018/044528 dated Oct. 25, 2018.

*Primary Examiner* — James M Ference
(74) *Attorney, Agent, or Firm* — Klintworth & Rozenblat IP LLP

(57) ABSTRACT

Beam segments made of a somewhat compressible material may be arranged with the top surface of each beam segment substantially in contact with the bottom surface of a next beam segment between a first beam segment and a last beam segment. A plurality of bolt bores extends between the top and bottom surfaces of each of the beam segments in substantial alignment through each of the beam segments. The bolt bores are spaced apart to receive corresponding bolt segments and tightening fasteners compressed between the first beam segment and the last beam segment. The beam segments may be compressed to form a combined beam structure that forms a building structure unit. The combined beam structure may be joined with other combined beam structures to form walls and floors for a building structure.

30 Claims, 17 Drawing Sheets

Related U.S. Application Data application No. 15/986,605, filed on May 22, 2018, now abandoned.

(60) Provisional application No. 62/539,546, filed on Aug. 1, 2017.

(51) Int. Cl.
*E04B 1/35* (2006.01)
*E04B 2/02* (2006.01)

(56) References Cited

U.S. PATENT DOCUMENTS 3,343,328 A * 9/1967 Rolle ..... E04B 2/704 52/605
3,449,875 A * 6/1969 Snedeker ..... E04B 2/704 52/223.7
4,089,144 A * 5/1978 Astl ..... E04B 2/706 52/281
4,305,238 A * 12/1981 Harward ..... E04B 2/702 428/17
4,353,191 A * 10/1982 Schilbe ..... E04B 2/702 52/233
4,463,532 A * 8/1984 Faw ..... E04B 1/10 52/233
4,503,648 A * 3/1985 Mahaffey ..... E04B 2/709 52/223.7
4,510,724 A * 4/1985 Magnuson ..... E04B 2/702 52/233
4,688,362 A * 8/1987 Pedersen ..... E04B 2/08 52/223.7
4,745,722 A * 5/1988 Ross ..... E04B 2/702 52/233
4,777,773 A * 10/1988 Fry ..... E04B 1/18 52/220.2
4,823,528 A * 4/1989 Faw ..... E04B 2/702 52/233
5,010,701 A * 4/1991 Halsey, Jr. ..... E04B 2/702 52/233
5,115,609 A * 5/1992 Sing ..... E04C 3/14 52/309.9
5,253,458 A * 10/1993 Christian ..... E04B 2/56 52/223.7
5,471,804 A * 12/1995 Winter, IV ..... E04B 1/14 403/231
5,570,549 A * 11/1996 Lung ..... E04H 9/14 52/295
5,657,597 A * 8/1997 Loftus ..... E02D 27/01 52/274
5,787,675 A * 8/1998 Futagi ..... E04B 2/702 411/389
5,806,249 A * 9/1998 Helms ..... E02D 29/02 52/102
5,881,515 A * 3/1999 George ..... E04B 1/34326 52/233
5,890,332 A * 4/1999 Skidmore ..... E04B 2/08 52/271
5,899,040 A * 5/1999 Cerrato ..... E04B 2/10 52/604
6,000,177 A * 12/1999 Davidson ..... E04B 2/709 52/233
6,023,895 A * 2/2000 Anderson ..... E04B 2/702 52/233
6,161,339 A * 12/2000 Cornett, Sr. ..... E04H 9/14 52/23
6,195,949 B1 * 3/2001 Schuyler ..... E04H 9/14 52/223.13
6,385,929 B1 * 5/2002 Englehart ..... F16B 7/18 52/233
6,931,803 B1 * 8/2005 Davis ..... E04B 1/28 52/251
7,117,647 B2 * 10/2006 Clarke ..... E04B 2/702 52/233
7,549,263 B1 * 6/2009 Porter ..... E04B 1/14 52/127.7
7,661,230 B2 * 2/2010 Peaco ..... E04B 2/702 52/233
8,387,338 B1 * 3/2013 Smith ..... E04F 15/08 52/745.09
8,701,364 B2 * 4/2014 Wrightman ..... E04B 2/702 52/233
9,428,926 B2 * 8/2016 Kramer ..... E04B 2/08
2002/0043038 A1 * 4/2002 Cerrato ..... E04C 5/08 52/604
2002/0046519 A1 * 4/2002 Houseal ..... E04B 2/702 52/233
2002/0124524 A1 * 9/2002 Lokken ..... E04B 2/02 52/747.1
2002/0157334 A1 * 10/2002 Smith ..... E04B 2/702 52/233
2003/0230032 A1 * 12/2003 Shahnazarian ..... E04H 9/14 52/167.3
2004/0134142 A1 * 7/2004 Stutts ..... E04B 2/702 52/233
2004/0187411 A1 * 9/2004 Clegg ..... E04B 2/702 52/233
2005/0081465 A1 * 4/2005 Crumley ..... E04H 9/14 52/223.1
2005/0126084 A1 * 6/2005 Woksa ..... E04B 2/702 52/79.1
2006/0248825 A1 * 11/2006 Garringer ..... E04B 2/705 52/233
2008/0072508 A1 * 3/2008 Tower ..... F16F 1/12 52/223.13
2008/0083177 A1 * 4/2008 Tiberi ..... B29C 44/1233 52/233
2009/0133345 A1 * 5/2009 Wrightman ..... E04B 2/702 52/233
2009/0199497 A1 * 8/2009 Wrightman ..... E04B 2/705 52/233
2009/0293390 A1 * 12/2009 Anderson ..... E04B 2/702 52/233
2010/0186316 A1 * 7/2010 Buchanan ..... E04B 1/10 52/167.1
2011/0239565 A1 * 10/2011 Clarke ..... E04B 2/702 52/233
2012/0031025 A1 * 2/2012 Cox ..... E04B 2/702 52/220.1
2013/0081343 A1 * 4/2013 Chadwick ..... E04B 2/702 52/223.14
2013/0175427 A1 * 7/2013 Moyher ..... E02D 27/02 249/18
2014/0326359 A1 * 11/2014 Bennett ..... B63B 3/04 141/1
2015/0184377 A1 * 7/2015 Stein ..... E04C 3/00 52/233
2016/0194869 A1 * 7/2016 Thornton ..... E04B 2/702 52/233
2017/0096813 A1 * 4/2017 Thornton ..... E04B 2/702
2019/0040629 A1 * 2/2019 Hanson ..... E04B 2/702
2019/0119876 A1 * 4/2019 Grussenmeyer ..... E04C 5/06

* cited by examiner

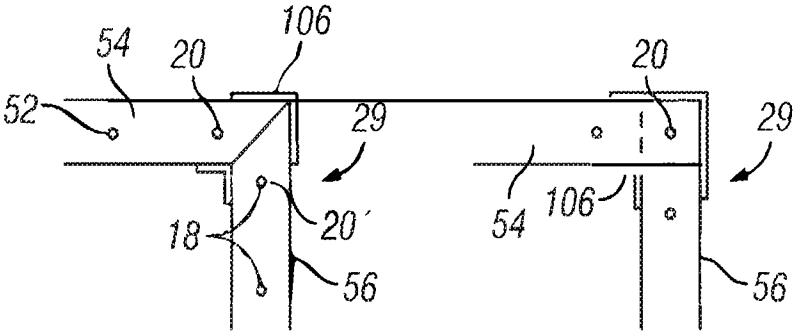
FIG. 12B
FIG. 12A
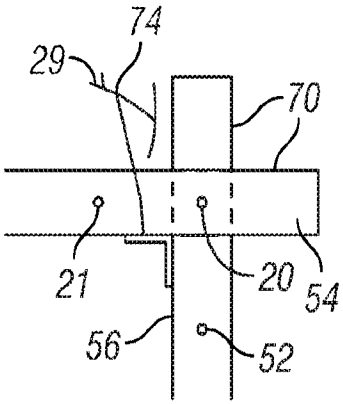
FIG. 12D
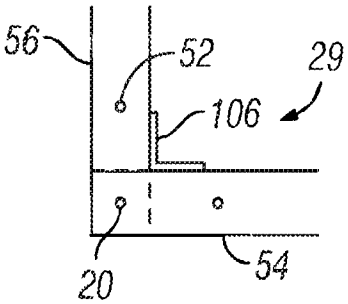
FIG. 12C
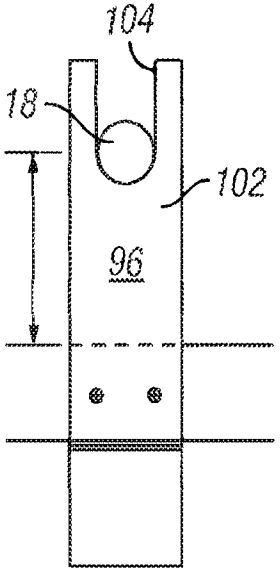
FIG. 11B
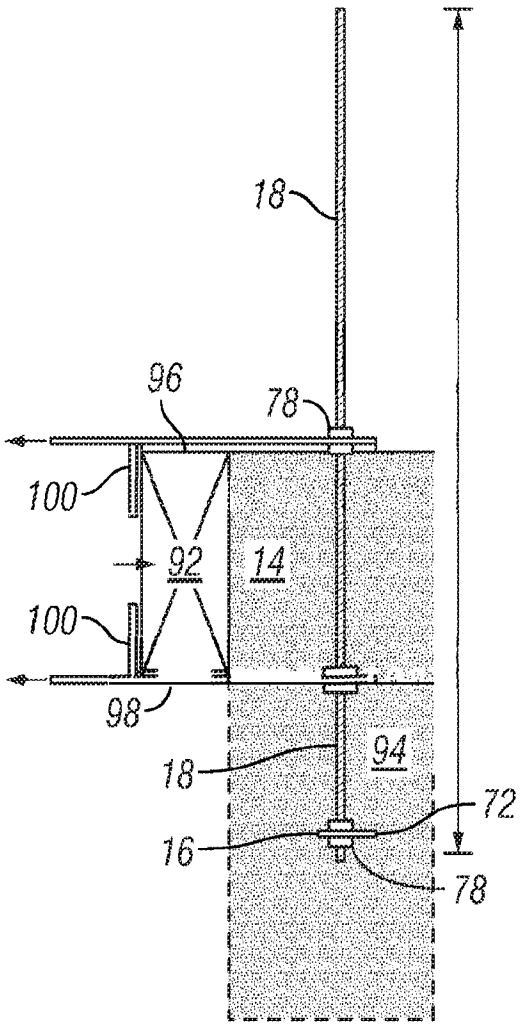
FIG. 11A

BEAM AND BOLTING CONSTRUCTION SYSTEM AND METHOD

This non-provisional application claims priority as a continuation-in-part of U.S. patent application Ser. No. 17/095,181, filed on Nov. 11, 2020, the contents of which are incorporated herein by reference. This non-provisional also claims priority of U.S. patent application Ser. No. 15/986,605, filed on May 22, 2018, the contents of which are incorporated herein by reference. This non-provisional application claims priority of Ser. No. 65/539,556, by the same inventor, filed Aug. 1, 2017, the contents of which are incorporated herein by reference.

BACKGROUND

Like nearly all other areas of knowledge and commerce, the field of dwelling construction is subject to continual improvements in techniques, use of materials, and related structural designs. This is certainly the case in the construction of dwellings such as cabins and small houses.

Although the concept of wooden dwellings goes back into prehistory, these have always been subject to problems, both in the construction methods and in the resulting products. For example, there are problems with traditional "log cabins" with respect to finding sufficiently uniform logs and requiring caulking materials (often requiring frequent renewal) to protect the inhabitants from the elements.

Wood constructions have many advantages, particularly since natural woods, with the exceptions of some hardwoods, have at least some degree of flexibility and compressibility. This allows for better weather sealing, and for better resistance to earthquake and wind damage. Better methods of improving these aspects are highly desirable.

Accordingly, there is significant room for improvement and a need for stronger and more easily constructed walls and frames for buildings.

SUMMARY

In view of the above, a combined beam structure includes a plurality of beam segments, each beam segment having a top surface and a bottom surface and made of a material that is at least slightly compressible. The plurality of beam segments is arranged with the top surface of each beam segment substantially in contact with the bottom surface of a next beam segment between a first beam segment and a last beam segment. A plurality of bolt bores extends between the top and bottom surfaces of each of the plurality of beam segments in substantial alignment through each of the plurality of beam segments. A plurality of bolt segments extends through corresponding bolt bores, and a plurality of tightening fasteners fasten to the bolt segments to apply compression between the first beam segment and the last beam segment.

In one aspect, the combined beam structure includes a joint side corresponding with a joint end portion of each of the plurality of beam segments. The joint end portion of each beam segment in a first subset of beam segments extend a distance from the joint end portion of each beam segment in a second subset of beam segments. The beam segments in the first subset of beam segments are arranged as alternating layers with the second subset of beam segments forming a staggered pattern of joint end portions at the joint side of the combined beam structure.

In another aspect, the combined beam structure is a first combined beam structure configured to couple with a second combined beam structure. The joint side is a first joint side of the first combined beam structure. The second combined beam structure is formed of another plurality of beam segments having a second joint side corresponding with joint end portions of the other plurality of beam segments arranged to form a staggered pattern on the second joint side of the second combined beam structure. The staggered pattern of the first joint side of the first combined beam structure interlocks with the staggered pattern of the second joint side of the second combined beam structure to form a wall structure junction between the first combined beam structure and the second combined beam structure.

In one example, the wall structure junction forms a wall corner between the first combined beam structure and the second combined beam structure extending at an angle with the first combined beam structure.

In an example wall corner, the first combined beam structure and the second combined beam structure form a substantially 90-degree angle.

In another example, the wall corner is formed with the joint end portions of the first combined beam structure extending to interlock with the joint end portions of the second combined beam such that the joint end portions of the first combined beam structure are flush with a planar surface of a wall structure formed by the second combined beam structure.

In another example, the wall corner is formed with the joint end portions of the second combined beam structure extending to interlock with the joint end portions of the first combined beam such that the joint end portions of the second combined beam structure are flush with a planar surface of a wall structure formed by the first combined beam structure.

In another example, the wall corner is formed with the joint end portions of the first combined beam structure extending to interlock with the joint end portions of the second combined beam such that the joint end portions of the first combined beam structure extend beyond a planar surface of a wall structure formed by the second combined beam structure.

In another example, the wall corner is formed with the joint end portions of the second combined beam structure extend to interlock with the joint end portions of the first combined beam such that the joint end portions of the second combined beam structure extend beyond a planar surface of a wall structure formed by the second combined beam structure.

In another aspect, the plurality of bolt bores in each of the plurality of beam segments includes a junction bolt bore in the joint end portion of each of the plurality of beam segments where the junction bolt bore aligns with a junction bolt bore at a joint end portion of the second combined beam structure at the wall structure junction.

In another aspect, the plurality of bolt bores in each of the plurality of beam segments includes an inner junction bolt bore disposed an inner junction distance from the junction bolt bore. The inner junction bolt bores of beam segments that extend to form the staggered pattern align with the junction bolt bores of non-extending beam segments.

BRIEF DESCRIPTION OF THE DRAWINGS

The purposes and advantages of example implementations will be apparent from the following detailed description in conjunction with the appended drawings in which:

FIG. 11A shows a system for precise anchoring of an elongated threaded bolt in the foundation slab.

FIG. 11B is a top plan view of a top (or bottom) mounting bracket for the system of FIG. 11A; and FIG. 12 shows in examples A, B, C, and D, four envisioned corner bracing configurations.

DETAILED DESCRIPTION

Figure 1:
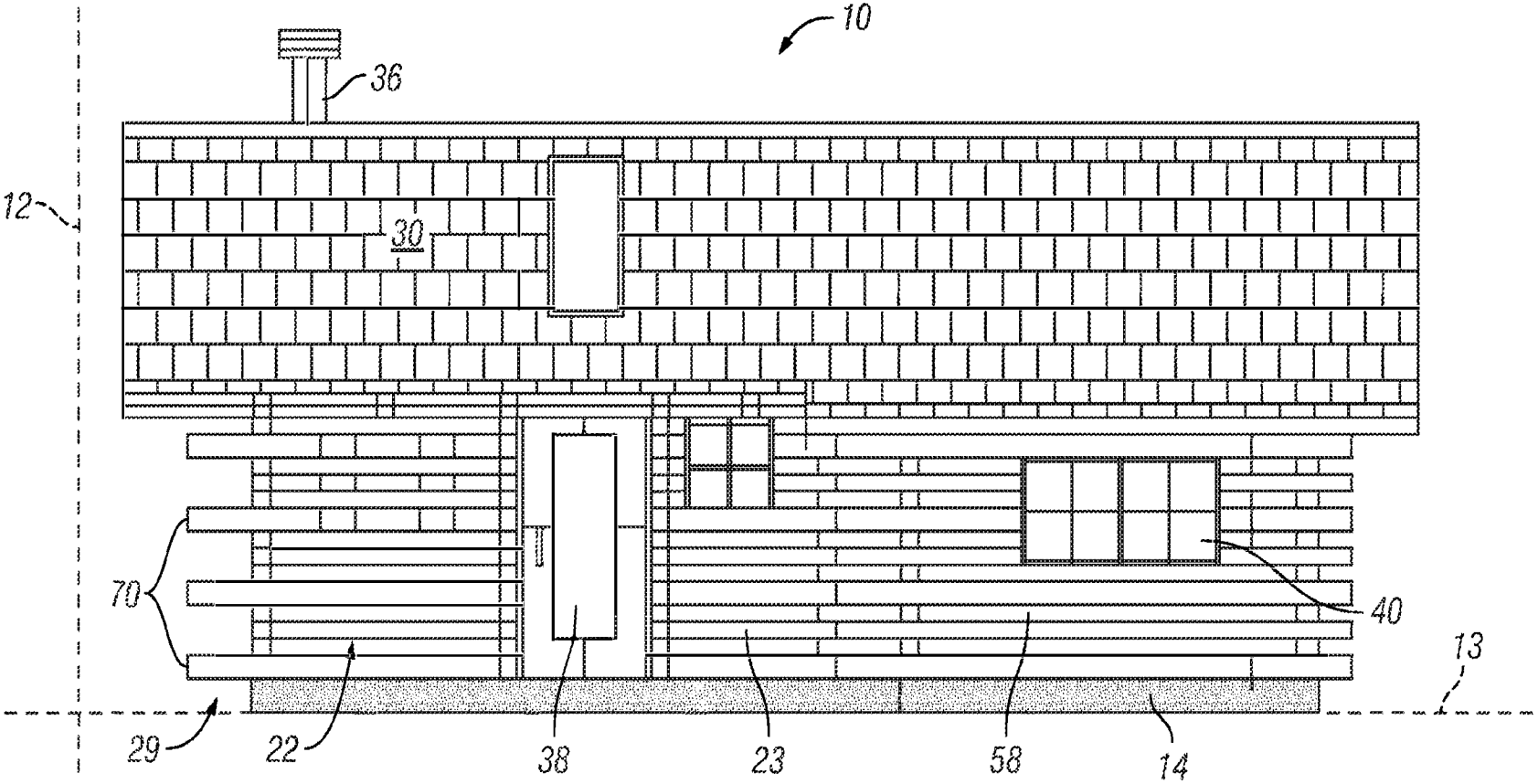
FIG. 1 is a front plan view of an example dwelling constructed using examples of combined beam structures.

Described below are examples of implementations of combined beam structures and methods of construction (M) for dwellings and other buildings utilizing beam and bolting and of the structures resulting therefrom. A front view of an example dwelling 10, in this case a cedar or redwood beam cabin, is illustrated in FIG. 1. The structure is defined in terms of the spatial relationships (shown in phantom) including a primary vertical plane 11 (in FIG. 3), a transverse vertical plane 12 perpendicular to the primary plane 11, and a horizontal plane 13 perpendicular to the vertical planes.

An example process (M) involves a series of steps in constructing and maintaining a beam and bolting building/dwelling. A brief summary of the steps is set forth below:

1. Select site and prepare layout, including bolting array positioning.
2. Locate corners for bolting on foundation slab.
3. Precisely locate bolt anchor locations for foundation slab.
4. Determine height of walls.
5. Select locations for gaps in walls (doors, windows, etc.).
6. Determine whether corners will have extended beam segments and sequential order of beam vertical overlap at corners.
7. Select materials.
8. Choose gauge and length of vertical bolts and choose nuts and washer plates.
9. Choose materials for beams (e.g., cedar, redwood, composite, etc.).
10. Determine cross-sectional structure of beams.
11. Determine default beam length.
12. Prepare foundation slab.
13. Situate and secure vertical bolts in predetermined bolt anchor locations defined by the bolting array.
14. Construct foundation slab to provide a flat upper surface and secure vertical bolt in precise vertical orientation.
15. Prepare beams.
16. Provide bolt bores through each beam in accordance with spacing of the predetermined vertical bolt locations.
17. Cut beam segments (truncated beam segments) to accommodate corners and wall gaps according to plans.
18. Vertically lower first beam in corner overlap sequence (cross beam) onto respective vertical bolts, including the selected corner bolt and at least one interstitial bolt, through respective bolt bores until it rests upon the foundation slab, and, if selected, extending beyond the corner bolt.
19. Vertically lower second beam in the corner overlap sequence (truncated transverse beam) onto respective interstitial vertical bolts such that it rests upon the foundation slab with a beam end abutting against the cross beam at the corner.
20. Repeat steps set forth in the two immediately preceding paragraphs, inserting bolt couplings and additional bolt segments as required, until all corners are completed.
21. If necessary, lay down beam segments on interstitial bolts to fill in any gaps not corresponding to doors, or the like in the layer.
22. Lay down additional layers until the desired wall heights are achieved, alternating the functions of the cross beam and the transverse beam in each successive layer such that the corner bolts alternatively pass through cross and transverse beams.
23. Upon achieving desired wall height:
    a. Lay down washer plates (pressure distribution plates) encompassing each of the vertical bolts on top of the beams; and
    b. Apply and tighten nuts to each of the treaded bolts to force all of the beams together to a desired pressure in order to achieve a desired "seal" and a secure structure.

24. Install a desired roof above the walls, maintaining an access gap above all bolts and nuts to allow subsequent pressure adjustment.

Other steps, which are not critical to the present invention, may also be performed. In addition, some of these steps may be omitted.

Figure 2:
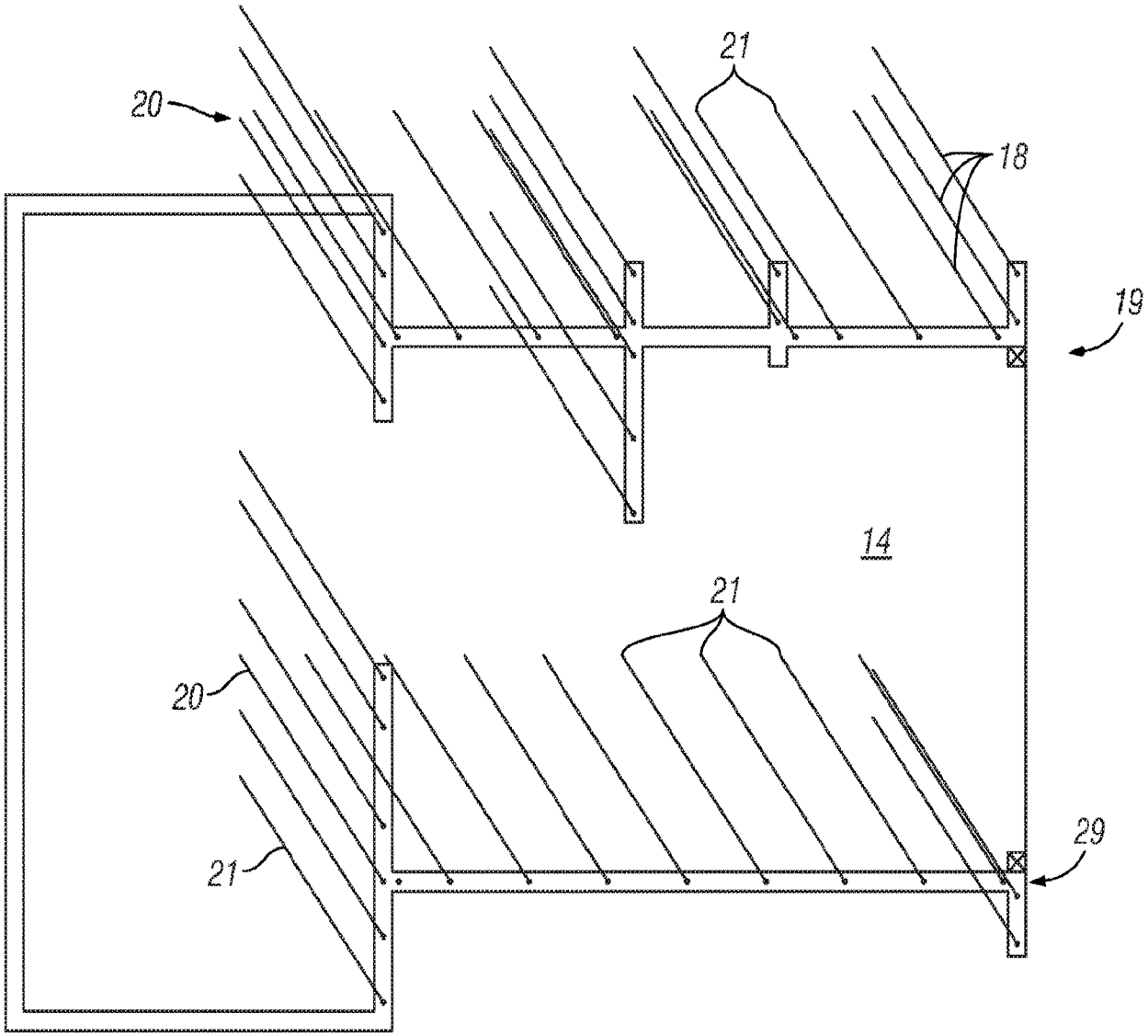
FIG. 2 is a perspective view of a construction site at an early stage, prior to installation of any beams, showing a typical bolting array.

Considering a product (in this case a building or dwelling) constructed in accordance with the above-described method (M) the example dwelling 10 is further explained below. For the purposes of simplified description, and since these are a matter of choice not critical to the invention, most architectural details and all interior details are omitted from the description. The example dwelling (cabin) 10 illustrated in FIGS. 1-4 includes a foundation slab 14, which is carefully aligned to be parallel to the horizontal plane 13. The initial actual construction step (after site and layout and materials selection) in the method (M) is to provide the flat (level) and horizontal (perpendicular to gravitational force) foundation slab 14 with bolt anchor locations 16 in which elongated vertical threaded bolt segments (vertical bolts) 18 are countersunk and secured in precise vertical orientation (see FIGS. 2, 7-9 and 11). The foundation slab 14 is typically poured concrete but other sturdy structural approaches may be used. The vertical bolts 18 are threaded (at least at the ends), are held in the bolt anchor locations 16 and are situated in a precise bolt array 19 corresponding to the dwelling design (an example array—not congruent to the example dwelling 10) is shown in FIG. 2). The array 19 includes corner bolts 20 and interstitial bolts 21 situated between corner bolts 20.

A further step in the construction method (M) relates to completing vertical walls mounted upon the vertical bolts 18. For simplicity of explanation, the example cabin 10 is rectangular, but a myriad of other configurations is possible. In the example dwelling 10 illustrated in FIGS. 1, 3, 4, and 6, a set of four exterior vertical walls 22 are provided. A front wall 23 and a rear wall 24 are aligned parallel to the primary vertical plane 11, and consequently with each other. Similarly, a left wall 26 and a right wall 28 are aligned parallel to the transverse vertical plane 12, and to each other. Each of the walls 22 will overlap at opposing ends with the respective perpendicular transverse walls at a corner 29, as described below. Each of the exterior walls 22 is constructed in accordance with the construction method (M).

A roof 30, of generally conventional construction, is mounted on and above the exterior walls 22 as described below. For at least a significant amount of the expanse, an access gap 32 separates the top of each exterior wall 22 from the roof 30 and any other overhead components, as explained below. Various other exterior details, not pertinent to the primary inventive concepts, are also shown and provided. These details include a fireplace 34 with an associated chimney 36, and doors 38 and windows 40 as desired.

Figure 5A:
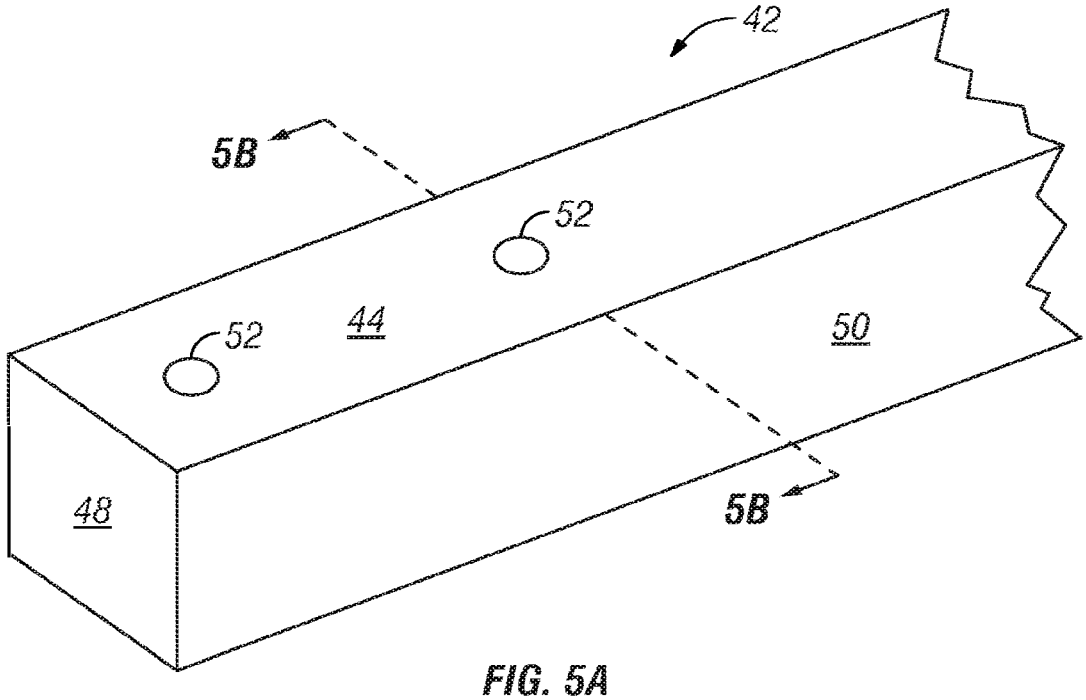
FIG. 5A is a truncated perspective view of an example beam for use in an example of a combined beam structure.
Figure 5B:
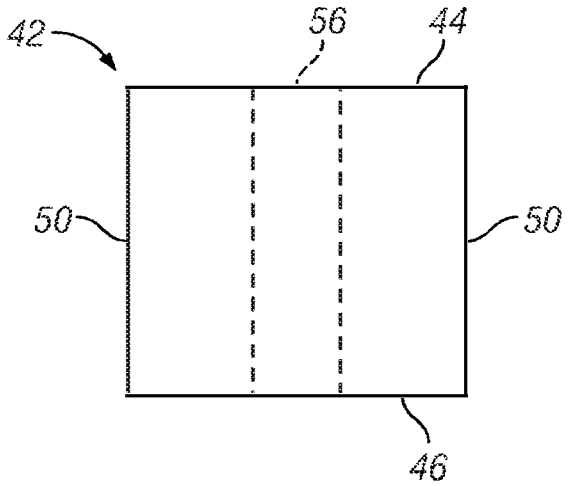
FIG. 5B is a cross sectional view of the beam of FIG. 5A, taken along line B-B.

The exterior walls 22 of the present invention are constructed with beams 42 as illustrated in more detail in FIGS. 5A and 5B. FIG. 5A is a perspective view of an example beam 42 while FIG. 5B is a cross sectional view taken along line B-B. The beams 42 are selected to have a beam top 44 and a beam bottom 46 which are flat and parallel to each other, and a pair of beam ends 48. The beams 42 also have beam edges 50 which may also be flat and parallel so that the beam has a rectangular cross section (square, as illustrated in FIG. 5B) but may also be beveled or otherwise shaped for aesthetic purposes as these surfaces are not critical to the effectiveness of the construction. In the example dwelling 10 the beams 42 are uniform in cross sectional dimensions but may vary in thickness as breadth as desired for particular purposes.

Each beam 42 includes series of bolt bores 52 vertically passing therethrough between the beam top 44 and beam bottom 46 surfaces. These bolt bores 52 are strategically spaced and located so as to correspond and mate with the specific bolt array 19. Each bolt bore 52 has a diameter slightly greater than the diameter of the selected vertical bolt segments 18.

Although all of the beams 42 in the example dwelling 10 are substantially similar for the purposes of construction method (M) it is convenient to refer to them separately for the purposes of description. Thus, some beams, which are aligned with the primary vertical plane 11 (e.g., front wall 23 and rear wall 24) are referred to as cross beams 54 while those aligned with the transverse vertical plane 12 (e.g., left wall 26 and right wall 28) are designated as transverse beams 56. An unmodified beam 42 such as is illustrated in FIG. 5A is referred to as a full beam 58, while a beam that is cut short so as to abut against a full beam 58 at a corner 29 is designated as a truncated beam 60. A beam segment 62 is defined as a section of a beam used to fill in gaps in the structure.

As described above with respect to the steps of the method (M), the exterior walls 22 are constructed in a vertically ascending series of layers, as the beams are fitted onto the respective vertical bolts 18. The layers are designated as an odd layer 64 (the lowest of which abuts against the foundation slab 14) and an even layer 66 which rests on top of an odd layer 64 to create a vertical overlap 68 of beams in adjacent layers at each corner 29. The discussion below with regard to FIG. 12 shows four envisioned corner overlap schemes for suitable stable corners 29.

Figure 3:
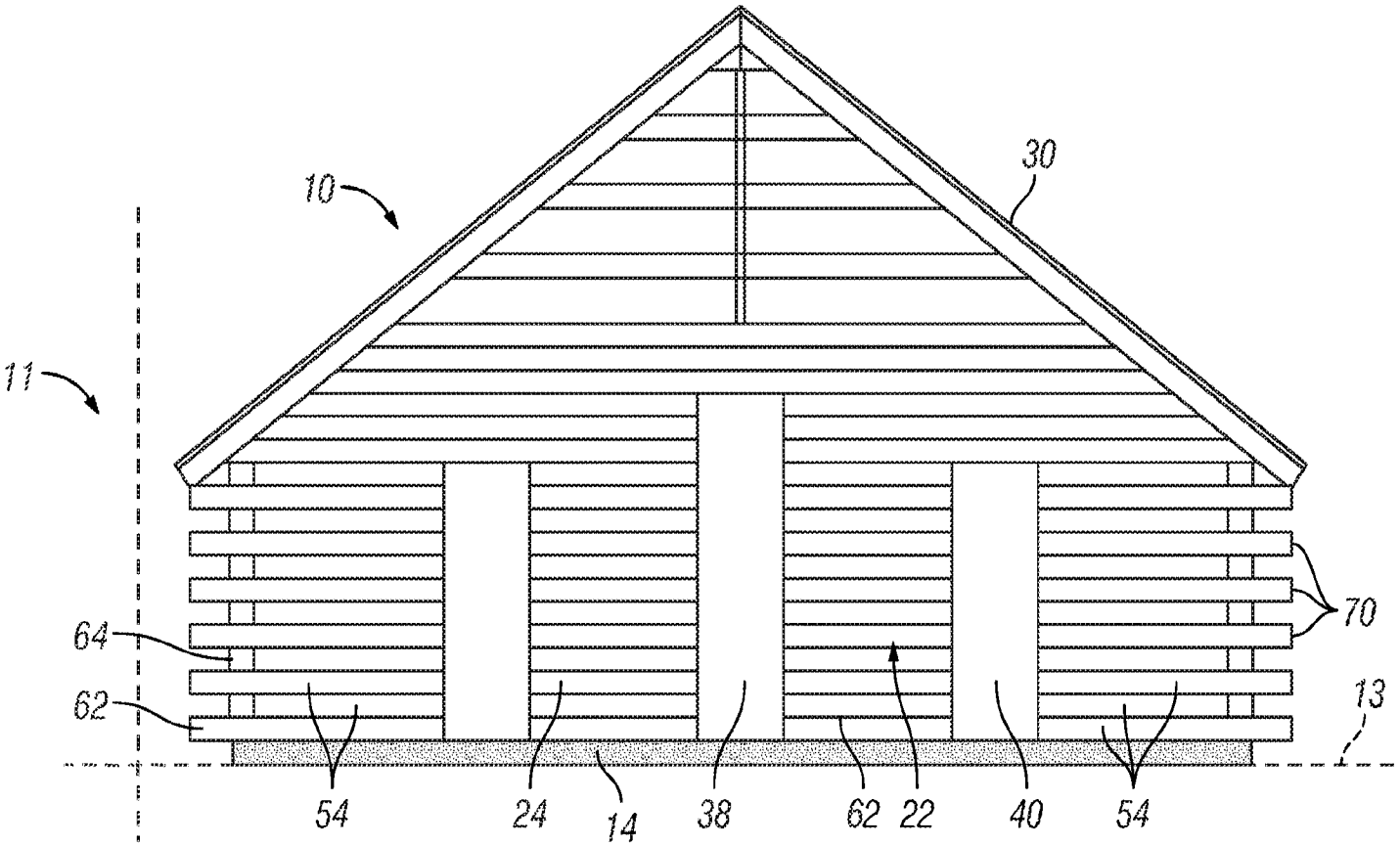
FIG. 3 is a plan view of the left side/end of the example dwelling.
Figure 4:
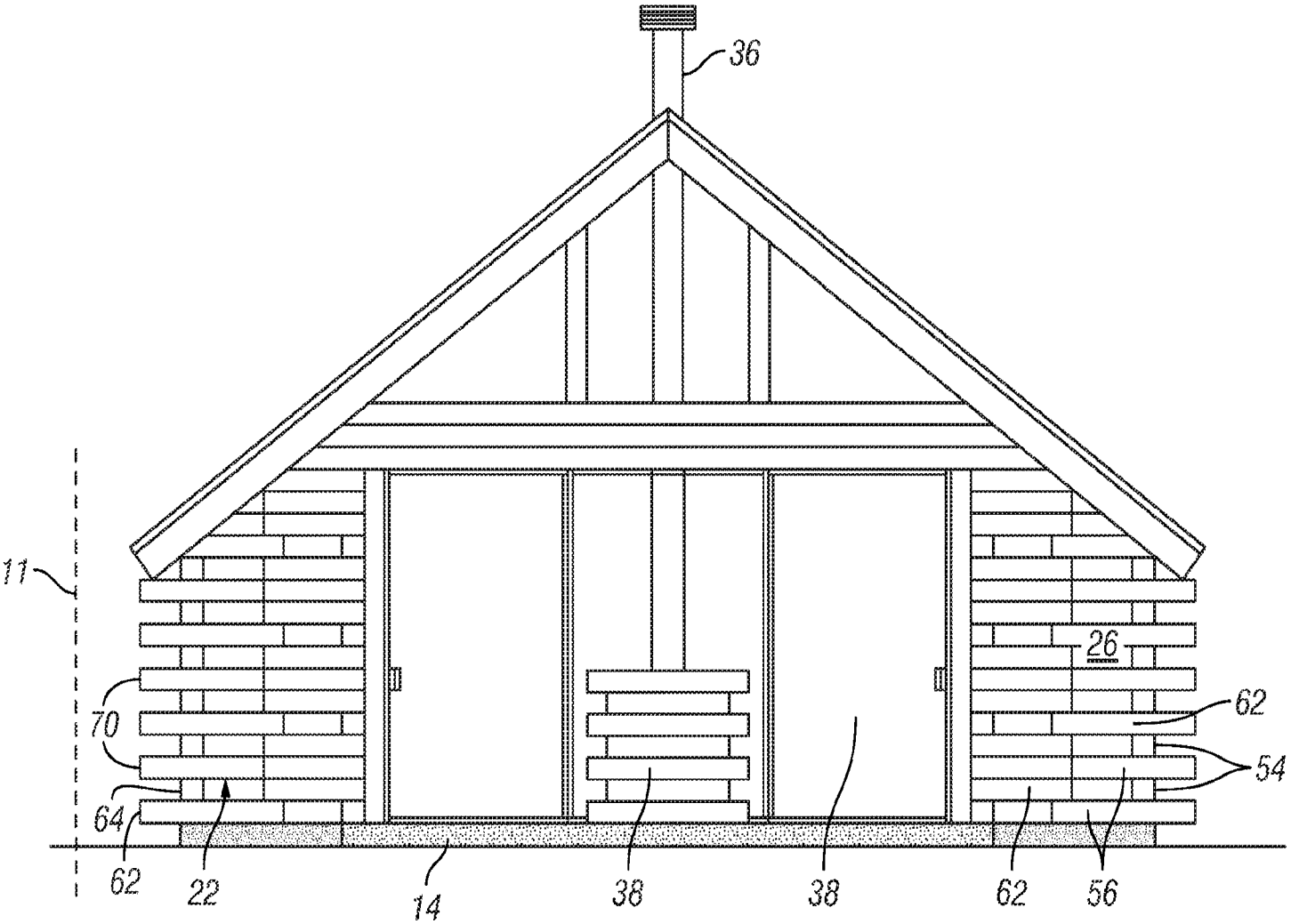
FIG. 4 is a rear plan view of the example dwelling.

For the purposes of description of an example embodiment (FIG. 12, depiction D), and referring to the left end of the front wall 23 (and the rear wall 24), the cross beam 54 in an odd layer 64, will be mounted to include a corner bolt 20, as illustrated in FIGS. 3 and 4. Referring to the corner 29 in the example dwelling 10 as shown in FIG. 10, the cross beam 54 includes an integral extended segment 70 which extends outward beyond the corner 29.

For the odd layers 64 the transverse beams 56 are truncated beams 60 which are mounted only on interstitial bolts 22 and have one beam end 48 which abuts against a cross beam 54 at each corner 29. For even layers 66, the roles are reversed (see FIGS. 4, 5, and 10) and the transverse beams 56 include extended segments 70 and are mounted to include a corner bolt 20, while the cross beams are truncated beams 60, and are mounted only on interstitial bolts 21.

In order to facilitate construction, it is ordinarily necessary to insert bolt couplings 71 at a convenient working height above the foundation slab 14. Workers can usually only effectively lift and position beams 42 on and over the vertical bolt segments 18 to a certain height which is usually consistent with the height of the bolt segment above the foundation slab 14. As the typical threaded bolt segment 18 is about six feet long in US constructions, and since bottom of the lowermost bolt segments is typically embedded about one foot into the foundation slab 14, the most common location to insert a coupling 71, with another bolt segment 18' in the same vertical alignment, will be at a height of about five feet above the foundation slab 14. The upper bolt segment 18' will then extend to slightly above the typical ten-foot height of each wall 22, and placement of the beams 14 will then be accomplished with the aid of scaffolding or mechanical lifts. The alternating layers continue until the desired wall height is reached. At this stage rigid washer plates 72 are placed over the elongated bolt 18' and against the top layer of the beams 42. Right angle corner plates 74 are situated on corner bolts 20 to lay against both abutting beams while elongated plates 76 are placed over interstitial bolts 21, preferably extending between two or more interstitial bolts. Nuts 78 are then threaded onto the respective elongated bolts 18' and tightened to the desired pressure levels, forcing the beams against the foundation slab 14 and each other to form a bolt laminated structure.

Figure 10:
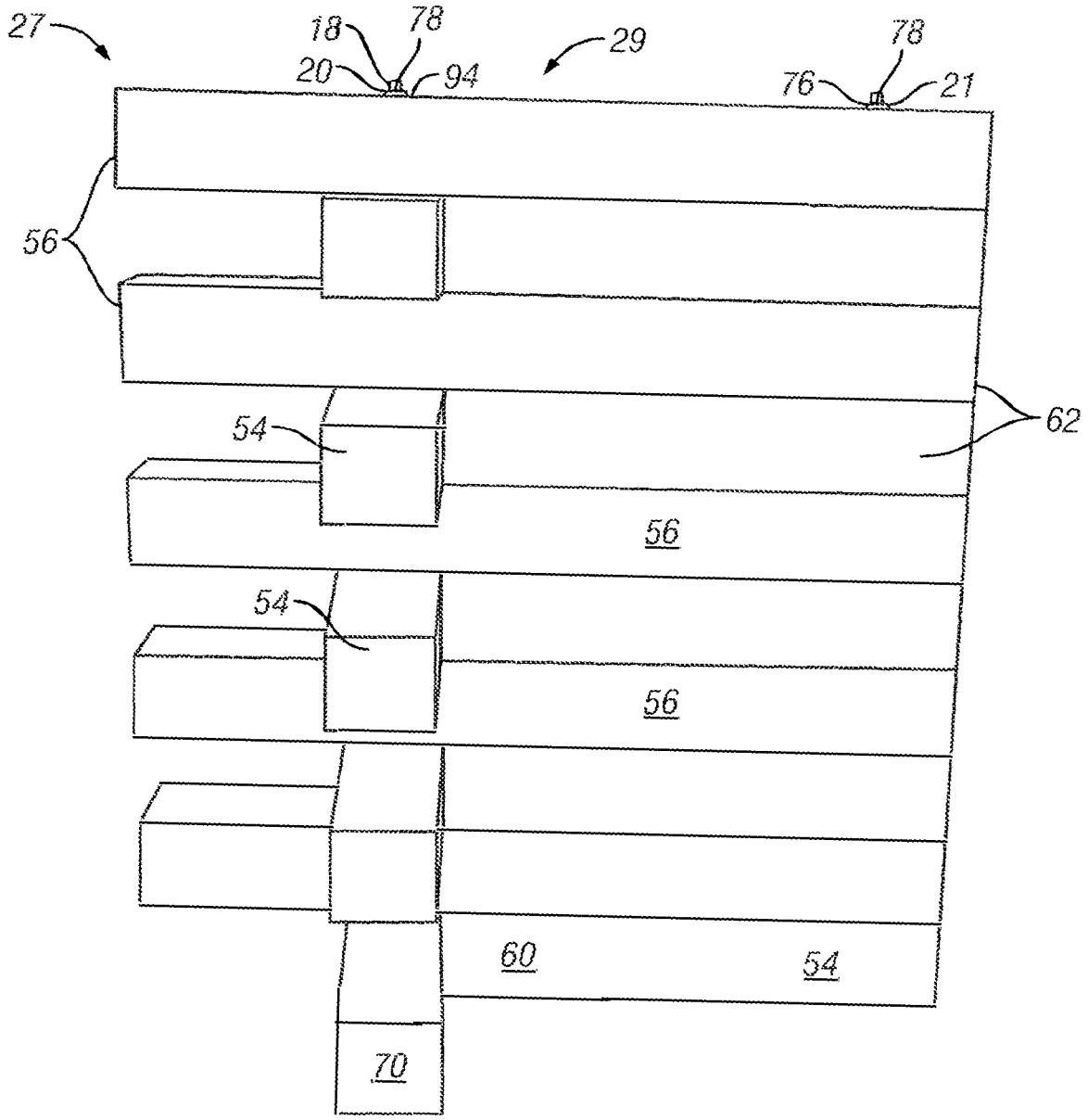
FIG. 10 is a side view of a prototype partial corner section of two very short exterior walls, showing the layering and bolting techniques.

A prototype shortened corner segment of intersecting walls is shown in FIG. 10. This shows the alternating levels, with extended segments 70 at appropriate levels of the cross beam 54 and transverse beam 56, as well as the corresponding abutment of a truncated beam 60 of the respective beam type for each level. Although shown without an elongated vertical bolt 18 anchored in a foundation slab 14 this also shows the washer plate 72 and nut 78 attached to be tightened to force the beams in adjacent layers together.

This prototype (FIG. 10) has been wind-tunnel tested and was shown to successfully withstand gale and hurricane force winds (from many angles and with winds of 50 to 150 mph) without any compromise of integrity.

Figure 8:
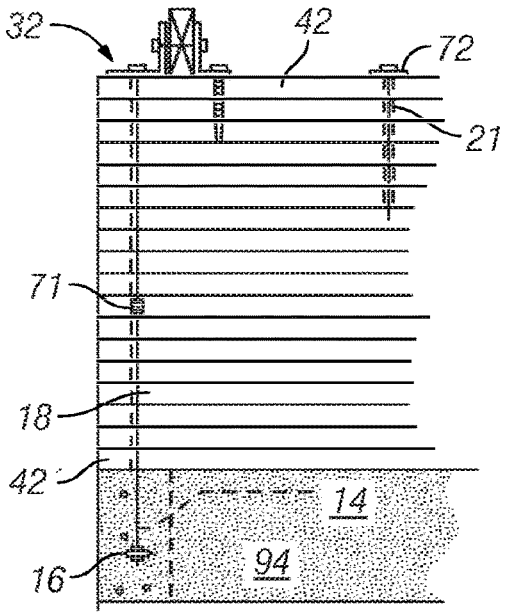
FIG. 8 is a fanciful cross-sectional illustration of a segment of a wall showing an interstitial bolt anchored in the foundation slab and extending upward to pass through the bolt holes in the beams.
Figure 9:
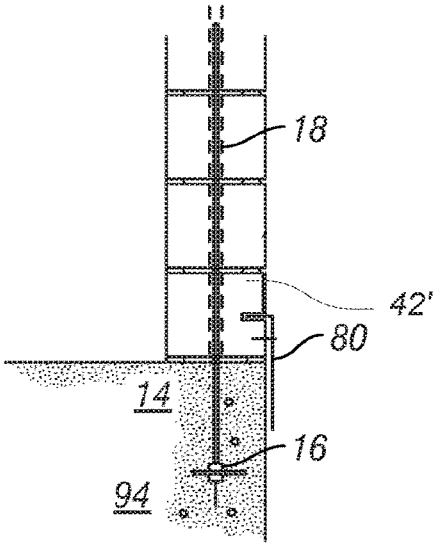
FIG. 9 is a fanciful cross-sectional view of a section of the foundation slab, an elongated bolt anchored in the slab and extending through bolt holes, and an alternate washer plate providing an external spacing and securing bracket.

FIGS. 8 and 9 illustrate, in fanciful cross-sectional views, the anchoring of elongated bolts 18 in the foundation slab 14 and extending upward through the bolt holes 52 of each beam in the layer. In FIG. 9 a spacing/securing bracket 80 is illustrated providing spacing between the foundation slab 14 and the bottom beam 42' and also engaging the bottom beam 42' to hold it securely in position.

Figure 6:
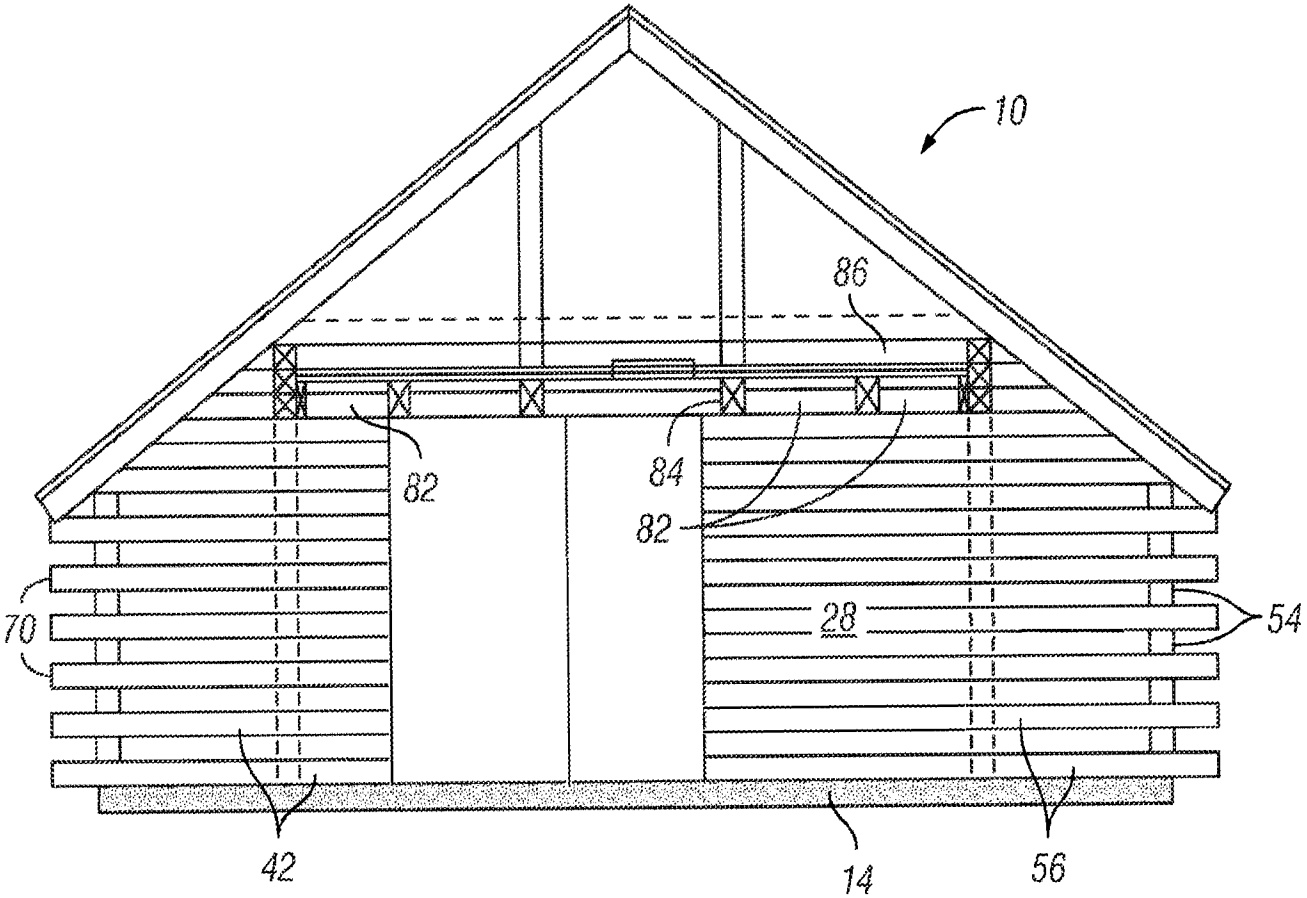
FIG. 6 is a plan view of the right side of the example dwelling, showing a roof mounting approach.
Figure 7:
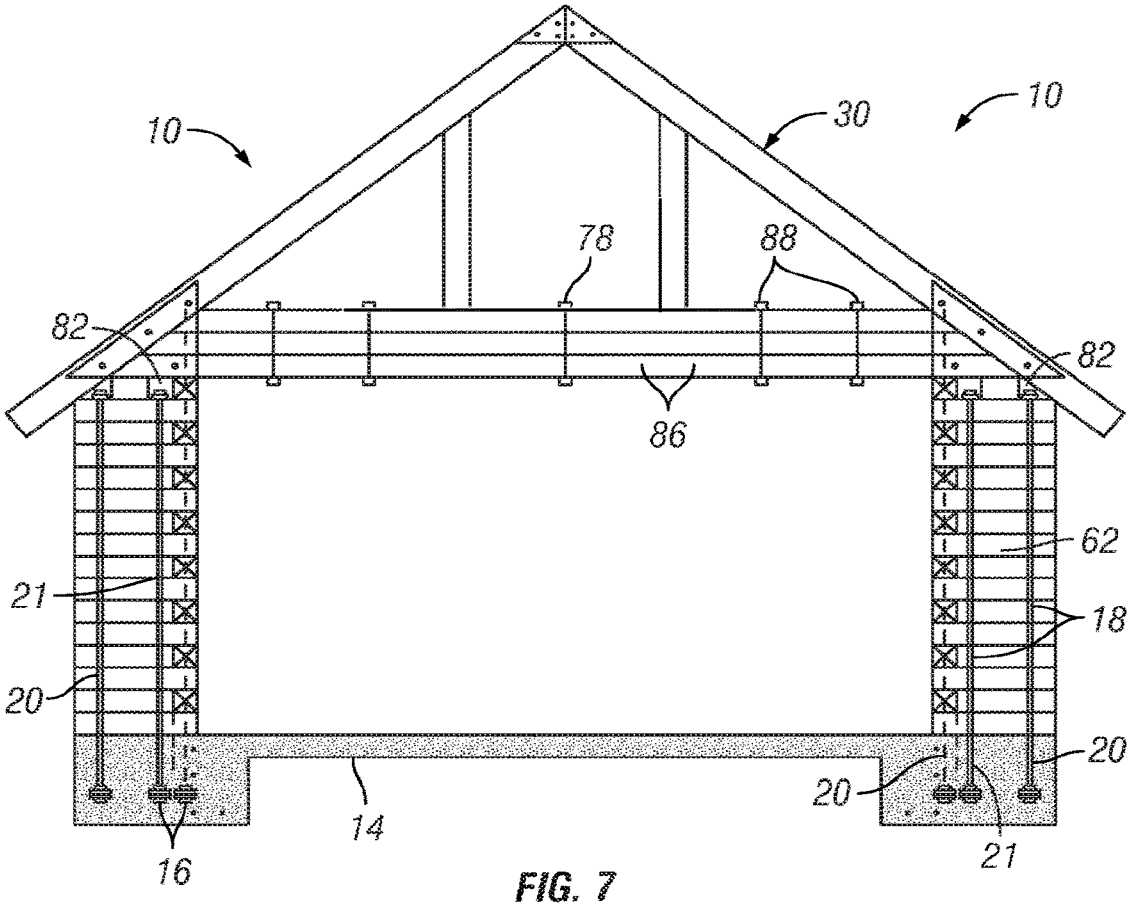
FIG. 7 is cutaway side view of an alternate dwelling, showing another roof mounting approach.

FIGS. 6 and 7 illustrate potential methods/arrangements for mounting a roof 30 onto a dwelling. It is emphasized in method (M) that any roof or ceiling structure requires that an access gap 82 is provided such that each nut 78 may be accessed from inside the structure in order to adjust the pressure level and compensate for the slight material deformations over time. It is also necessary that the roof 30 be secured to the wall structures. In order to typically accomplish this a series of roof spacer blocks 84 (beam segments including bolt bores 52) are placed on top of the wall 28 intermediate the access gaps 82. These roof spacer blocks 84 and rafters 86 and other connective portions of the roof 30 are then secured to the top and potentially lower beams. The securing method includes roof bolting 88 having threaded bolt segments 18' with an additional coupling 71 to extend through the upper beams 42 to beyond and through and above the spacer blocks 84 and rafters 86 and provided with washer plates 72 and nuts 78 to tighten the wall and roof elements together in a stable and secure fashion. Depending on the nature of the roof 30, the rafter bolting 88 and roof spacer blocks 84 may only be needed on some of the exterior walls 22.

As other roof construction details are not strictly pertinent to the invention or method (M) these are not addressed herein.

FIGS. 11 (A & B) and 12 (A, B, C, and D) show examples of helpful construction details and alternate corner bolting configuration in accordance with the present invention.

FIG. 11 illustrates, both in cut away view (11A) and top view (11B), an alignment system 90 for placing and aligning each bottom vertical bolt 18 in the desired bolt anchor location 16 in the foundation slab 14. Prior to pouring the foundation slab 14, a foundation frame 92 is placed around the desired border. This is typically in the form of a wooden border, in the illustration a 4×8 board. The foundation frame rests outside a foundation cavity 94, into which the concrete or other solid filler will be poured once the bolt array 19 is prepared. A nut 78 is threaded onto the vertical bolt segment above the level of the foundation frame 92, while a further nut 78 and washer plate 72 are situated well below, near the nether end of the bolt segment 18.

A top bracket 96 and a bottom bracket 98 are adapted to fit about the upper and lower surfaces of the foundation frame 92 and extend into the foundation cavity 94. The top bracket 96 and lower bracket 98 each include a right-angle flange 100 to abut against the outside of the foundation frame to form a horizontal plate 102, with a centering notch 104 at its interior end in order to receive the bolt segment 18. When the brackets 96 and 98 are properly placed and aligned, the bolt segment 18 is placed to vertically fit into the centering notches 104 of both brackets, with the exterior nut 78 tightened to secure the bolt segment 18 into position and alignment. When all necessary alignment systems 90 are set up around the perimeter (and in portions of the interior when interior walls or the like are included in the plan), the foundation slab 14 may be poured to set each bolt segment into the bolt anchor locations 16 of the array 19. The top bracket 96 and bottom bracket 98 may either be left in place or laterally slid out as the foundation slab hardens.

FIG. 12 shows (in sub-Figures A, B, C, and D) four possible desirable corner 29 structures, each including one or more "L" brackets 106 situated on the interior or exterior angle, or both. In three of the example corners 29 (B, C, and D), the corner bolt 20 extends through the actual corner location and through the alternating layers 64 and 66 of the beams. In the upper right example (FIG. 12A) there are two offset corner bolts 20' passing through respective cross beams 54 and transverse beams 56, each of which is trimmed at a forty-five degree angle so as to abut each other at the apex of the corner 29. The lower left example (FIG. 12D) is the top view of a corner 29 as described above for the example dwelling 10 (FIG. 7).

The materials selected for the components of the building constructed according to the Method (M) are structurally strong. In one example implementation, the foundation slab 14 is poured concrete, but other materials may also suffice. The elongated threaded bolts 18 may be formed of construction steel and have dimensions as described above. The beams 42 may be selected from stable, yet slightly deformable woods, such as cedar or redwood, while other types of slightly compressible materials, such as synthetic and composite materials, all having compatible upper and lower surfaces, may also be suitable. The beams 42 may be elongated and have square cross sections. The beams 42 may be of a uniform thickness for alternating layers, however, beams of differing heights (thicknesses) may be used, so long as each layer has a uniform thickness. Bolt hole 52 separation and locations in the beams 42 may be standardized and prefabricated beams 42' may be provided such that onsite drilling is avoided and time is saved.

It is noted that the bolt array 19 defines an exterior frame 108 for the dwelling 10 and the exterior frame 108 defines an interior 110 for the dwelling 10.

Example implementations of systems and methods for constructing dwellings and other building structures using beams and bolting arrays incorporated in a foundation slab are described above. Examples of systems and methods for construction of building structures are described below with reference to FIGS. 13A, 13B, and 14-23 in which a foundation slab is not used. In accordance with examples described below, combined beam structures may be assembled and used as wall or floor or ceiling sections at a building site. The combined beam structures may be delivered to a building site in a prefabricated or assembled state for assembly at the building site.

Figure 13A:
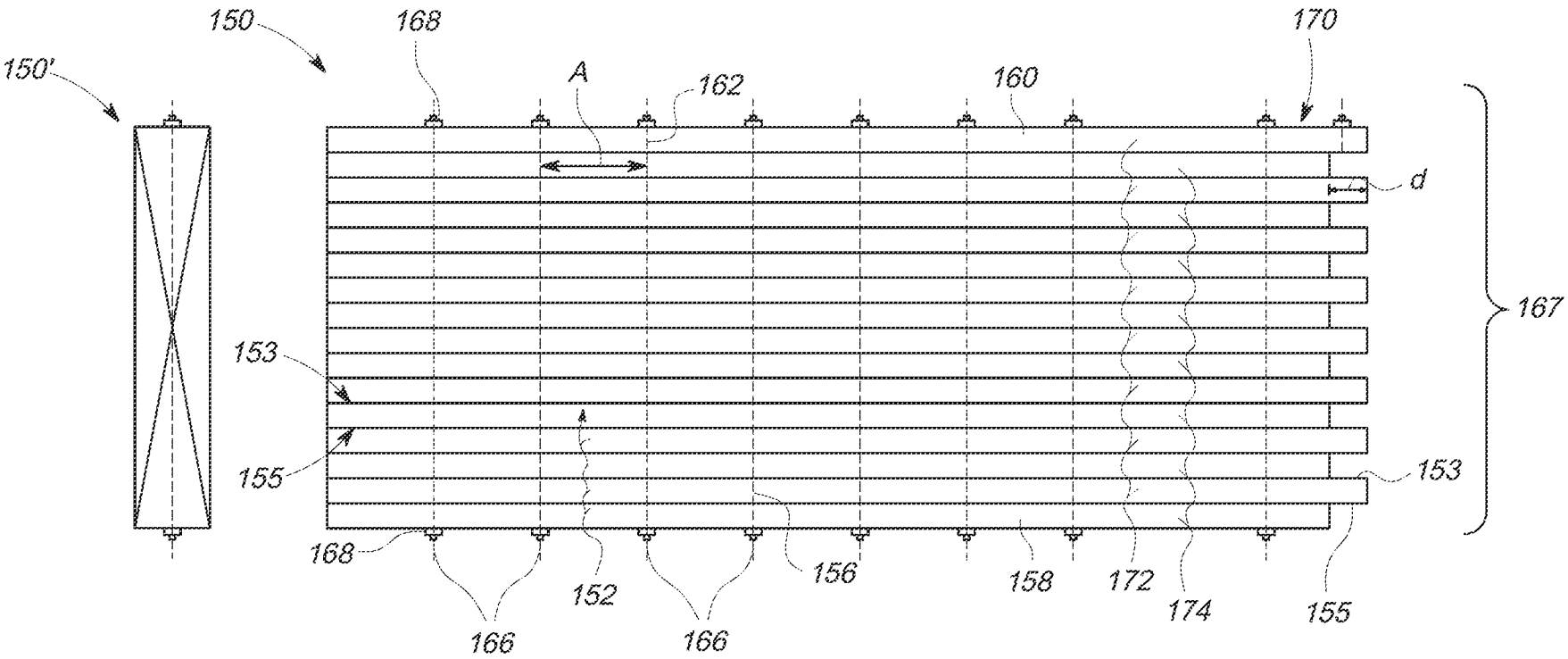
FIG. 13A is a front plan view and a side section view of an example implementation of a combined beam structure.

FIG. 13A is a front plan view and a side section view of an example implementation of a combined beam structure 150 comprising a plurality of beam segments 152 each having a top surface 153 and a bottom surface 155 and made of a material that is at least slightly compressible. The plurality of beam segments 152 may be arranged with the top surface 153 of each beam segment 152 substantially in contact with the bottom surface 155 of a next beam segment between a first beam segment 158 and a last beam segment 160 in the combined beam structure 152. Each beam segment 152 in the example beam segments 152 in FIG. 13A includes a plurality of bolt bores 162 extending between the top surface 153 and bottom surface 155 of each of the plurality of beam segments 152. The bolt bores 162 may be formed as described above with reference to bolt bores 56 in FIGS. 5A and 5B. The bolt bores 162 may be formed so as to substantially align through each of the plurality of beam segments 152 in the combined beam structure 150 in a spaced apart arrangement A.

The combined beam structure 150 includes a plurality of bolt segments 166 extending through corresponding bolt bores 162. A plurality of tightening fasteners 168 may be attached to the bolt segments 166 to apply a compression force between the first beam segment 158 and the last beam segment 160 in the combined beam structure 150. In an example implementation, the tightening fasteners 168 include nuts 78 and washers 72 of the type described above with reference to FIG. 11A having threads matching the bolt segments 166.

Each beam segment 152 in the combined beam structure 150 includes a joint end portion 170 disposed in a joint side 167 of the combined beam structure 150. The joint end portion 170 of each beam segment 152 in a first subset of beam segments 172 extends a distance d from the joint end portion of each beam segment in a second subset of beam segments 174. The beam segments 152 in the first subset of beam segments 172 are arranged in alternating layers with the second subset of beam segments 174 to form a staggered pattern at 167 of joint end portions 170 at the joint side 167 of the combined beam structure 150.

The combined beam structure 150 shown in FIG. 13A may be used as a construction unit for constructing a building structure. The combined beam structure 150 may for example be used to form walls of a building structure by joining the combined beam structure with other combined beam structures. The combined beam structure 150 may for example be implemented as a prefabricated wall unit. The tightening fasteners 168 may be tightened when installed at the building site to form a substantially solid wall unit as illustrated in the side section view 150' of FIG. 13A. In some implementations, the wall unit may form a sufficiently solid structure that may be used as a wall of a large fluid containing vessel. An adhesive may be added between the top and bottom surfaces 153 and 155 to enhance the impermeability of such a vessel.

It is noted that the combined beam structure 150 in FIG. 13A has a joint side with a staggered pattern on one side of the combined beam structure. In another example, the combined beam structure 150 may have joint sides with staggered patterns on both sides. In another example, the combined beam structure may include joint sides without staggered patterns and use a separate joining structure to provide attachment between two combined beam structures.

Figure 13B:
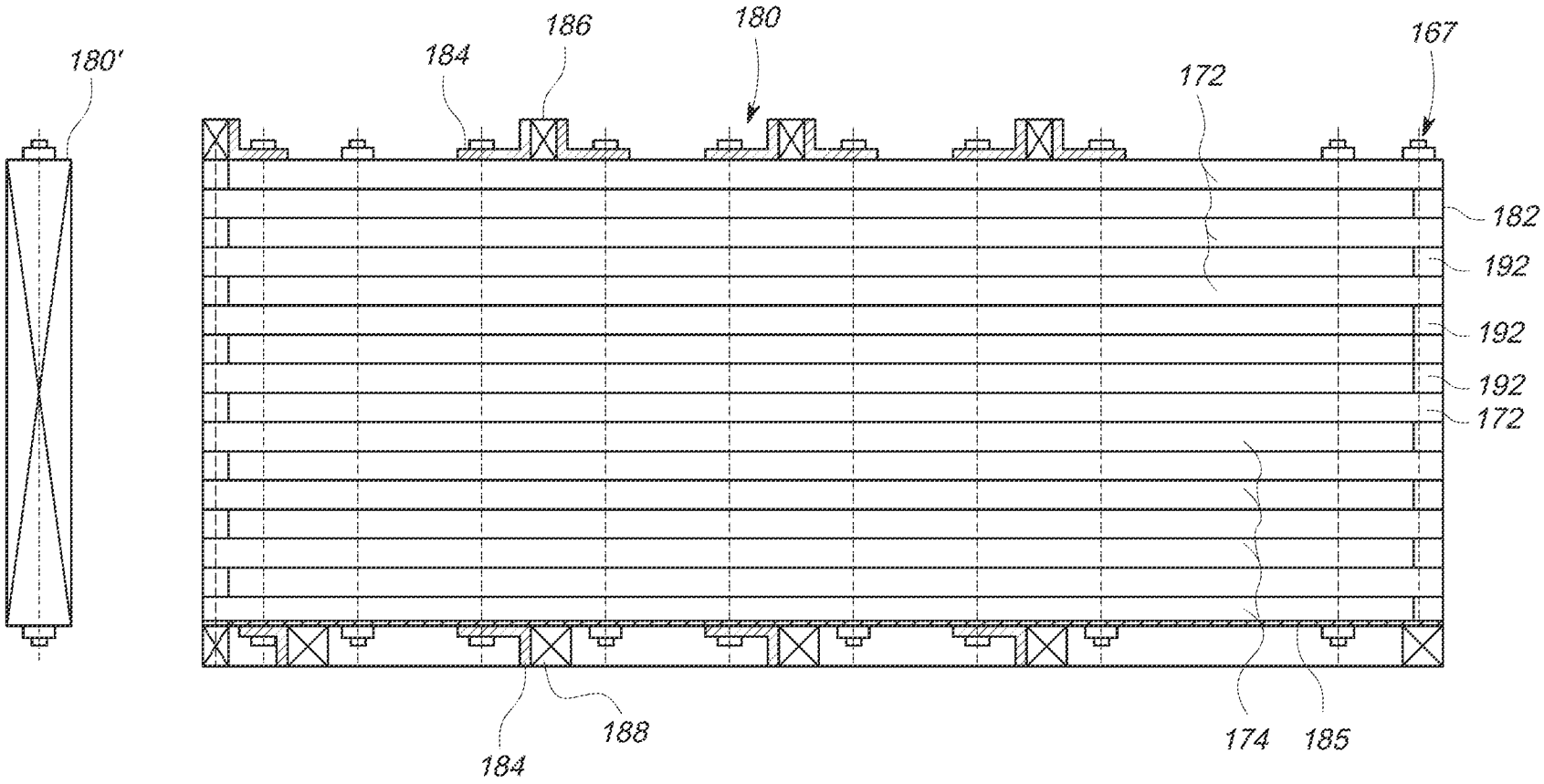
FIG. 13B is a front plan view and a side section view of another example implementation of a combined beam structure.

In one example implementation, the staggered pattern formed at the joint side 167 of a first combined beam structure 150 may be interlocked with a complementary staggered pattern at the joint side of a second combined beam structure. FIG. 13B is a front plan view and a side section view of another example implementation of a combined beam structure 180 comprising the plurality of beam segments 152 arranged as described with reference to FIG. 13A. The combined beam structure 180 in FIG. 13B includes a plurality of bracket structures 184 on a top side and on a bottom side of the combined beam structure 180. The bracket structures 184 on the top side of the combined beam structure 180 may be attached in one plane to the combined beam structure 180 and in the other plane to a top cross beam 186. The bracket structures 184 on the bottom side of the combined beam structure 180 may be attached in one plane to the combined beam structure 180 and in the other plane to several bottom cross beams 188. A floor 185 implemented as, for example, a sheet of plywood, or another solid material, may be mounted on top of the cross beams 188 and under the combined beam structure 180. The top cross beams 186 may form a part of a ceiling structure of a building structure, such as a dwelling, or a room in a building structure. The bottom cross beams 188 may form a part of a foundation of the building structure.

The combined beam structure 180 in FIG. 13B is shown attached to a second combined beam structure 182 at the joint side 167 of the combined beam structure 180. The second combined beam structure 182 includes a plurality of beam segments 152 of the type used for the plurality of segments in the first combined beam structure 180. The plurality of beam segments in the second combined beam structure 182 include a first subset of beam segments 192 arranged in a complementary fashion with the first subset of beam segments 172 of the first combined beam segment 180. The first subset of beam segments 172 with extending portions relative to the second subset of beam segments 174 alternate with the extending portions of the first subset of beam segments 192 of the second combined beam structure 182. In this manner, the staggered pattern of the joint side 167 of the first combined beam structure 180 interlocks with the joint side of the second combined beam structure 182.

Figure 14:
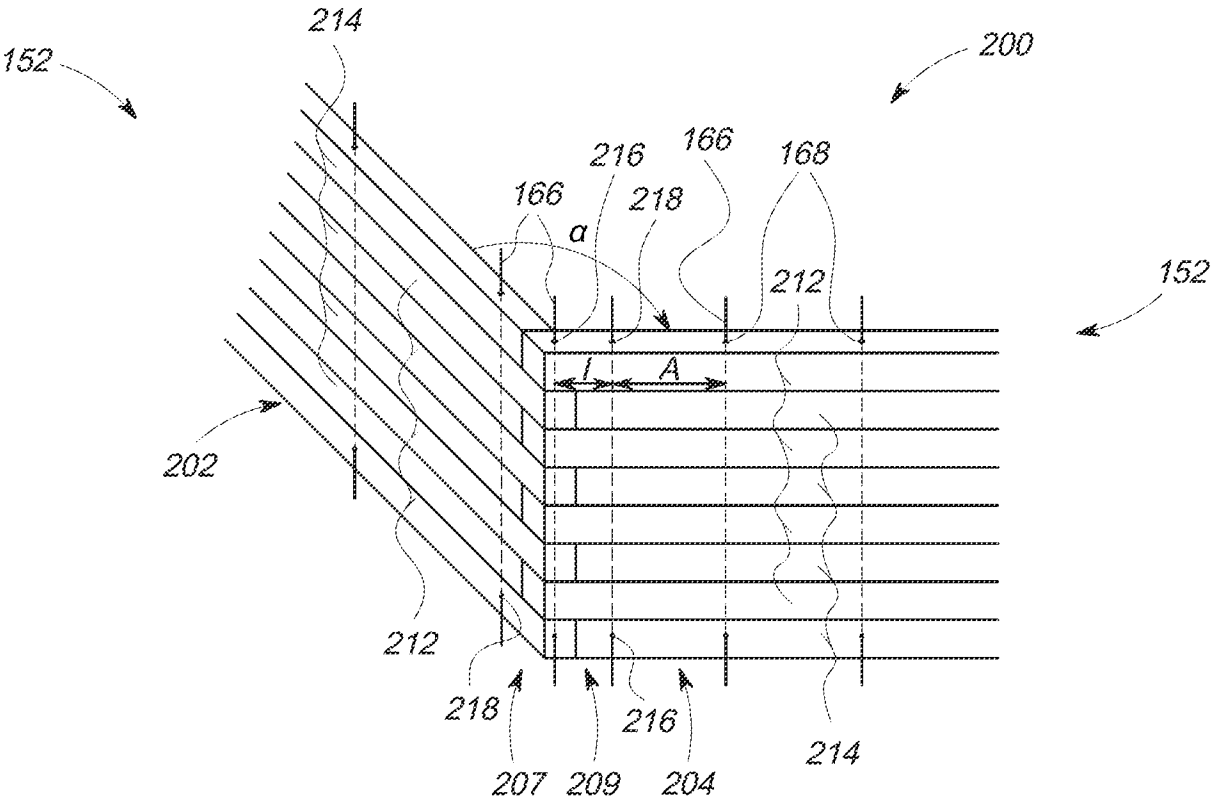
FIG. 14 is an isometric view of an example of a wall junction structure formed as a wall corner.

FIG. 14 is an isometric view of an example of a wall junction structure 200 formed as a wall corner. The wall junction structure 200 is formed by a first combined beam structure 202 and a second combined beam structure 204. The first and second combined beam structures 202 and 204 include a plurality of beam segments 152 arranged as described with reference to FIG. 13A. The staggered pattern formed at a joint side 207 of the first combined beam structure 202 interlocks with the staggered pattern formed by a joint side 209 of the second combined beam structure 204. The wall junction structure shown in FIG. 14 forms a junction at an angle $\alpha$ of substantially 90 degrees to form a wall corner. The angle $\alpha$ may be any angle up to 180 degrees. The angle $\alpha$ may be varied as described below with reference to FIG. 17 to form structures of different shapes.

The wall junction structure 200 in FIG. 14 forms a wall corner using a junction bolt bore 216 in the joint end portion of each of the plurality of beam segments 152. The junction bolt bore 216 in the joint end portion of the first subset of the beam segments 212 in the first combined beam structure 202 aligns with the junction bolt bore 216 in the joint end portion of the first subset of beam segments 212 in the second combined beam structure 204 at the wall structure junction 204.

The plurality of beam segments 152 in each combined beam structure 202, 204 includes an inner junction bolt bore 218 disposed an inner junction distance I from the junction bolt bore 216. The inner junction bolt bores 218 in the first subset of beam segments 212 in the first combined beam structure 202 are configured to align with the junction bolt bores 216 in the second subset 214 of the beam segments in the first combined beam structure 202. Similarly, the inner junction bolt bores 218 in the first subset of beam segments 212 in the second combined beam structure 204 are configured to align with the junction bolt bores 216 in the second subset 214 of the beam segments in the second combined beam structure 204.

The junction bolt bores 216 and inner junction bolt bores 218 in the beam segments 152 that form the wall junction structure 200 in FIG. 14 may be configured to receive bolt segments 166 in a manner similar to the bolt bores 168 arranged in the beam segments 152. The inner junction bolt bores 218 may be disposed the distance I from the junction bolt bores 216 and a distance A from the next bolt bore 168 in each beam segment 152. In example implementations, the distance/between the corner bolt bores and the distance A between the remaining bolt bores 166 may be the same. In other examples, the distance I may be less than the distance A to impart enhanced compression forces in the region of the structure corner thereby strengthening the integrity of the overall structure.

The wall junction structure 200 in FIG. 14 is formed with the joint end portions of the first combined beam structure 202 that extend to interlock with the joint end portions of the second combined beam structure 204 having a cross-sectional surface being flush with a planar surface of a wall structure formed by the second combined beam structure 204. In addition, the joint end portions of the second combined beam structure 204 that extend to interlock with the joint end portions of the first combined beam structure 202 are flush with a planar surface of a wall structure formed by the first combined beam structure 202.

In alternative embodiments, the joint end portions of the beam segments of either combined beam structures may extend beyond the planar surface formed by either combined beam structure. In an example implementation, the joint end portions of the beam segments may extend beyond the corner formed by the combined beam structures in a manner similar to that illustrated in FIG. 10.

Figure 15:
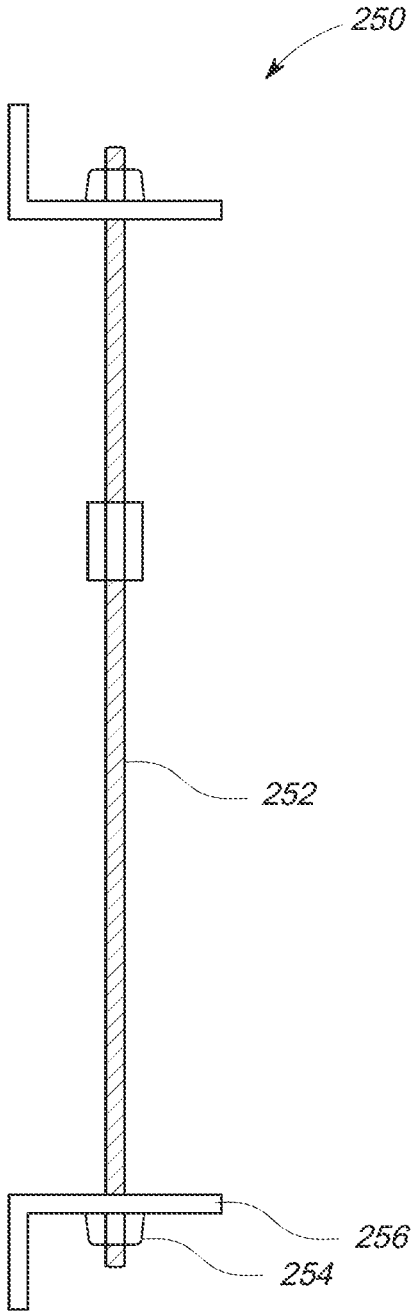
FIG. 15 illustrates an example of a bolt segment.

The plurality of beam segments 152 in the combined beam segments in FIGS. 13A, 13B, and 14 may be made of any suitable compressible material such as, for example, natural wood, cedar, redwood, wood composites, and synthetic materials. Thee beam segments 152 may be of any suitable size. In one example implementation, beam segments are 6×6 wooden beams, but 4×4, 8×8, or any other beam size may be used. Illustrated examples use substantially square cross-sectional beam segments. However, bean segments having other rectangular, or non-rectangular cross-sections may be used as well. The bolt segments 166 may be any suitable rod-shaped member adapted to receive a tightening fastener. FIG. 15 illustrates an example of a bolt segment 250 having a thread 252 configured to receive a nut 254 and a washer 256.

In an example implementation, the first combined beam structure 202 and the second combined beam structure 204 in FIG. 14 may be arranged over a foundation, which may be gravel prepared to support a building structure. The foundation may also be a deck, or a set of beams mounted on posts inserted into the ground. The first combined beam structure 202 and the second combined beam structure 204 may be provided with the bolt segments 166 and tightening fasteners 168 inserted into the bolt bores 162, but not into the junction bolt bores 216 or the inner junction bolt bores 218. The staggered pattern of the joint side 207 of the first combined beam segment 202 may be interlocked with the staggered pattern 209 of the second combined beam segment 204 with the junction bolt bores 216 and the inner junction bolt bores 218 are aligned as described above. A bolt segment 166 may be inserted into each of the junction bolt bores 216 and inner junction bolt bores 218 as described above to integrate the joint ends of the first combined beam structure 202 and the second combined beam structure 204. The tightening fasteners 168 may then be tightened to strengthen the wall junction structure 200.

Figure 16:
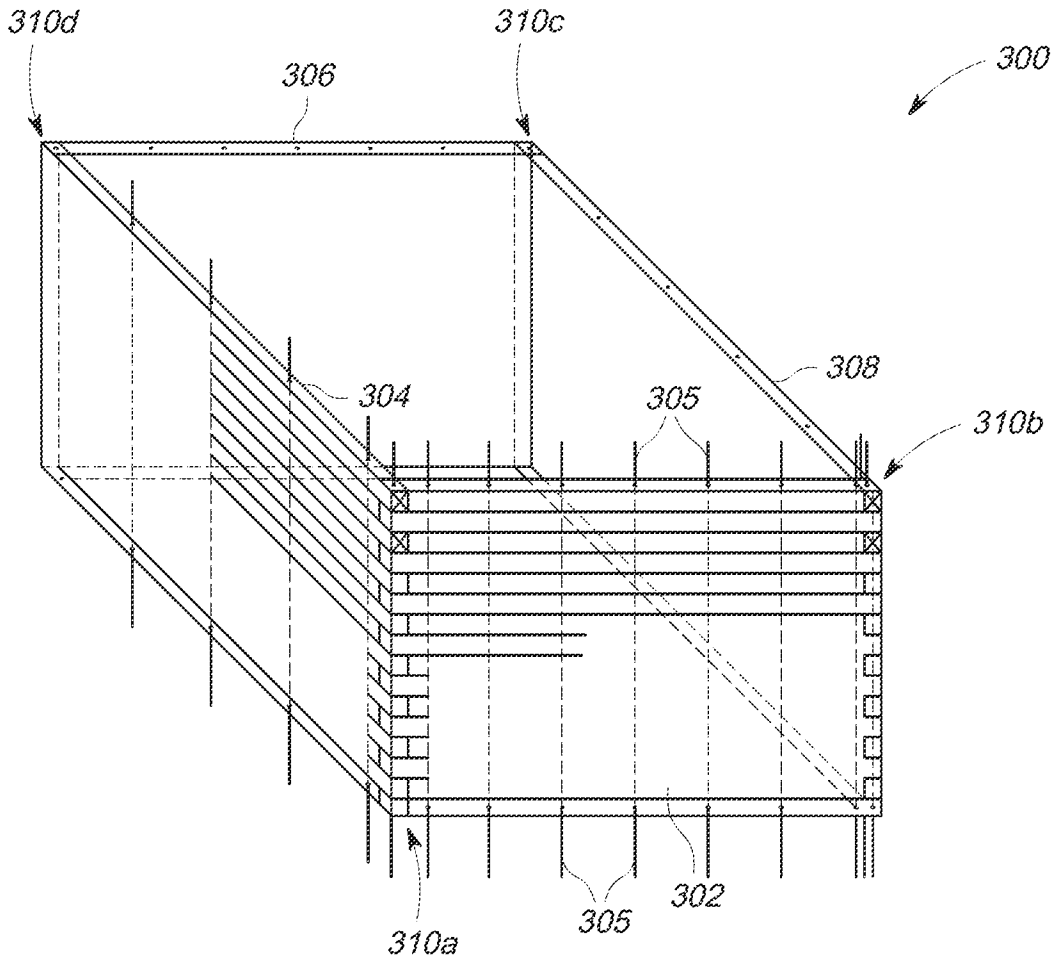
FIG. 16 is an isometric view of an example building structure.

In example implementations, the combined beam structures described above with reference to FIGS. 13A, 13B, and 14 may be used to assemble a building structure. FIG. 16 is an isometric view of an example building structure 300 formed by a first combined beam structure 302, a second combined beam structure 304, a third combined beam structure 306 and a fourth combined beam structure 308. The combined beam structures 302, 304, 306, 308 are arranged and joined at wall corners 310*a*, 310*b*, 310*c*, and 310*d* to form a substantially rectangular structure. The wall corners 310 may be formed as described above with reference to FIG. 14. In particular, the junction bolt bores, the inner junction bolt bores, the corresponding bolt segments, and the interlocking of the joint sides of the combined beam structures cooperate to strengthen the building structure 300 at the junctions between the combined beam structures. By tightening the tightening fasteners at each bolt segment, the attached combined beam structures are joined to form a unitary building structure. In addition, each bolt segment or selected bolt segments may be extended above or below the building structure at 305. The extended bolt segments 305 may be used to attached to rafters above the building structure 300 or to a floor or foundation below the building structure at 305.

Figure 17:
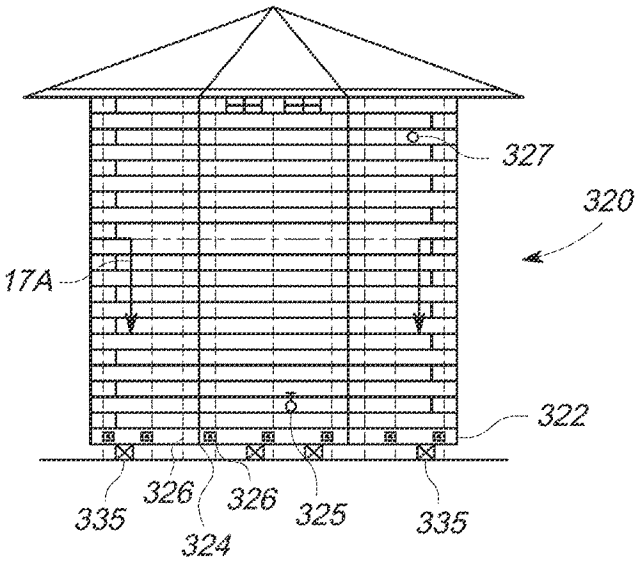
FIG. 17 illustrates another example building structure and a top view of an example combined beam structure used as a floor.
Figure 17A:
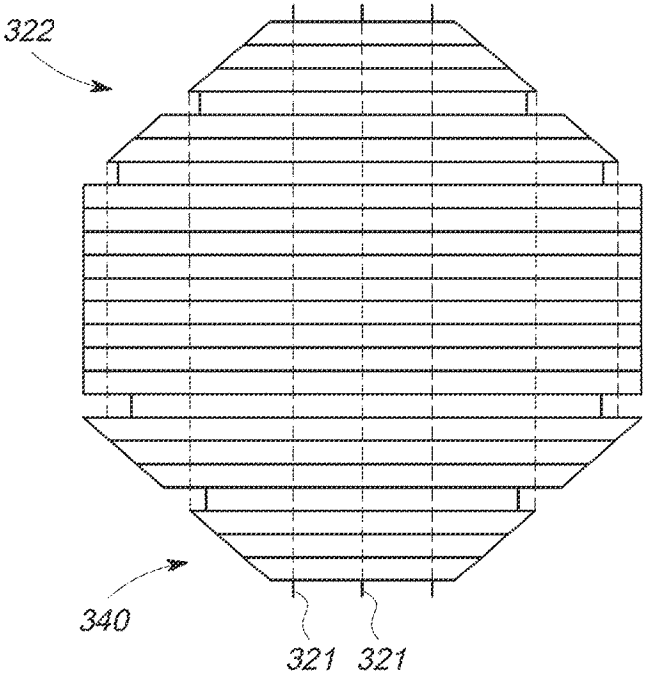
FIG. 17A is a top cross-sectional view of the building structure in FIG. 17 at cross-section 17A.
Figure 17A:
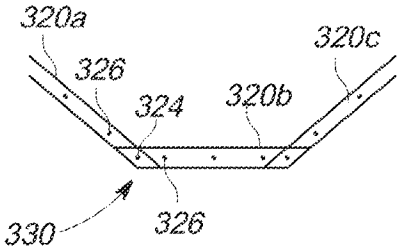

In example implementations, a combined beam structure may be part of the building structure as a floor. FIG. 17 is a front plan view of another example building structure 320 and a top view of an example combined beam structure used as a floor 322. The building structure 320 in FIG. 17 comprises 8 combined beam structures attached to form a structure having an octagonal shape from a top view. FIG. 17A depicts a top view cross-section 17A of a portion of the front section of the building structure 320 illustrating a first combined beam structure 320*a* joined to a second combined beam structure 320*b*, which is further attached to a third combined beam structure 320*c*. The combined beam structures 320*a-c* are joined at an angle sufficient to form the octagonal shape with five other combined beam structures. The combined beam structures 320*a-c* are joined using a three-bolt segment wall junction structure that includes two inner junction bolts 326 and a junction bolt 324 as described above with reference to FIG. 14.

The floor 322 includes a plurality of beam segments 340 arranged horizontally and joined with horizontal bolt segments 321 in a manner similar to that described above with reference to FIG. 13A. The combined beam structures 320 may be mounted on the floor 322 as shown in FIG. 17. The integrated building structure may then be mounted on a plurality of posts 335 or on another foundation structure. In an example implementation, the bolt segments and tightening fasteners forming the beam composite structures of the building structure and of the floor 322 may be tightened sufficiently to form an integrated structure. The tightening of the bolt segments, which may be performed using an impact driver, for example, combined with the compressibility of the beam segments may allow for the building structure 320 to function as a water container. The building structure 320 in FIG. 17 includes a water spigot 325 to allow water to exit and a water inlet 327 to allow water or any other liquid to flow into the building structure 320.

Figure 18:
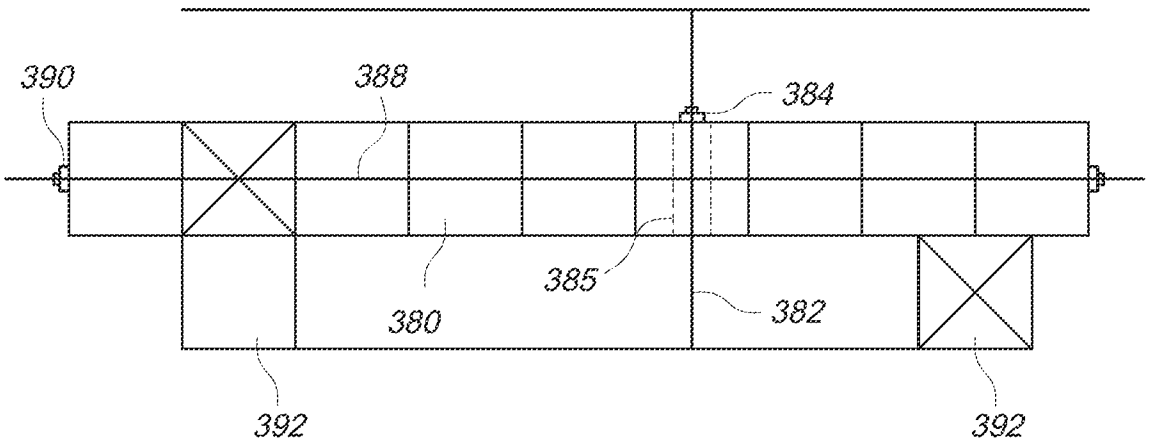
FIG. 18 illustrates example mechanisms for attaching a bolt segment to a combined beam structure configured to function as a floor.

FIG. 18 illustrates example mechanisms for attaching a bolt segment 382 to a combined beam structure 380 configured to function as a floor. The horizontal combined beam structure 380 formed using horizontal bolt segments 388 may be mounted on posts 392 or beams supported by the ground, or by other structures such as a deck. The horizontally disposed combined beam structure 380 may include a cross bolt bore 385 to receive a vertically disposed bolt segment 382, which may be secured to the floor combined beam structure 380 using a nut and washer 384 combination. The vertical bolt segment 382 may be one of a plurality of bolt segments that are part of vertically disposed combined beam structures forming walls for the building structure.

Figure 19A:
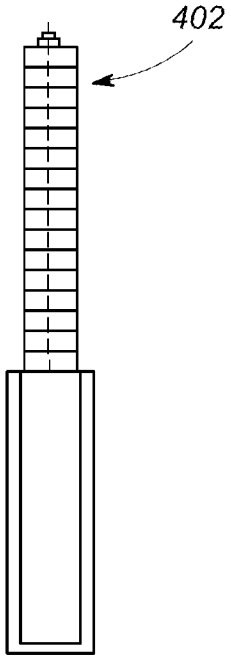
FIGS. 19A and 19B are cross-sectional views of portions of the alternative mechanism for providing a foundation shown in FIG. 19 at cross-sections 19A and 19B, respectively.
Figure 19:
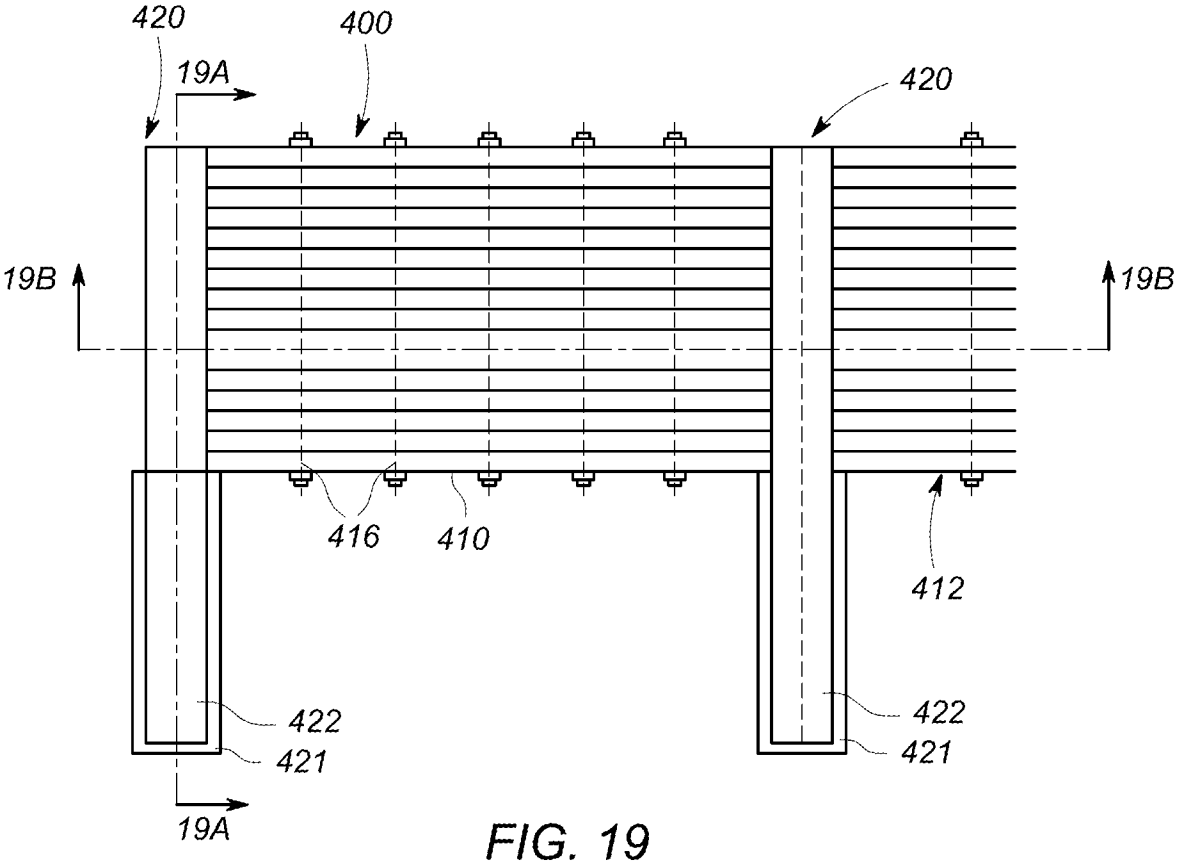
FIG. 19 illustrates another example implementation of a combined beam structure and an alternative mechanism for providing a foundation for the combined beam structure in a building structure.
Figure 19B:
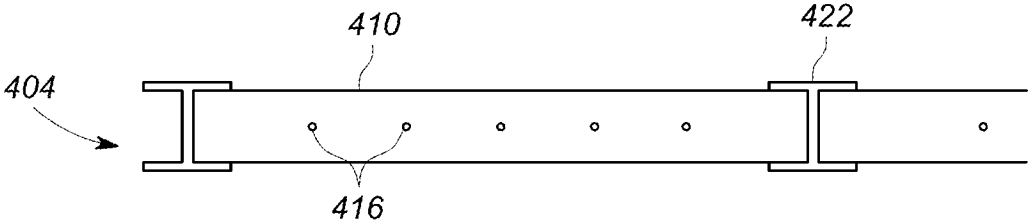

FIG. 19 is front plan view 400, a side section view 402, and a top view 404 of another example implementation of a wall junction structure 420 for joining a first combined beam structure 410 and a second combined beam structure 412. The wall junction structure 420 uses an alternative mechanism for joining the combined beam structures 410 and 412, and for providing a foundation for a wall formed by the multiple combined beam structures. The first combined beam structure 410 and the second combined beam structure 412 may be constructed as described above with reference to FIG. 13A, but with an even, not staggered pattern, on each side of the combined beam structures 410, 412. The sides of each combined beam structure 410, 412 may be inserted into I-beams 422. The combined beam structures 410, 412 may extend from opposite sides of the I-beams 422 to form an extended wall. The I-beams 422 may also be buried into postholes 421 to secure building structure to the ground. In this manner, the postholes 421 may be said to provide a foundation for the building structure.

Many modifications to the above embodiment may be made without altering the nature of the invention. The dimensions and shapes of the components and the construction materials may be modified for particular circumstances. While various embodiments have been described above, it should be understood that they have been presented by way of example only, and not as limitations.

What is claimed is:

1. A building structure comprising:

a first combined beam structure comprising a first plurality of beam segments, a second combined beam structure comprising a second plurality of beam segments, and a third combined beam structure comprising a third plurality of beam segments, each of the first, second, and third plurality of beam segments comprising a first beam segment and a last beam segment, each of the beam segments in the first, second, and third plurality of beam segments having a rectangular cross-section including a planar top surface and a planar bottom surface extending between a pair of beam ends, and arranged with at least most of the top surface of each of the plurality of beam segments in direct contact with at least most of the bottom surface of a next one of the plurality of beam segments between the first beam segment and the last beam segment, where each beam segment includes a plurality of bolt bores extending between the top and bottom surfaces in substantial alignment through each of the first, second and third plurality of beam segments, where the bolt bores are formed in a spaced apart arrangement and configured to receive a corresponding plurality of bolt segments configured to receive a plurality of tightening fasteners for applying compression between the first beam segment and the last beam segment in each of the first, second and third plurality of beam segments;

where the first, second and third plurality of beam segments are made of a material that is compressible to form an integrated structure when the tightening fasteners are tightened; and a first wall structure junction between the first combined beam structure and the second combined beam structure formed by a joint side of the first combined beam structure interlocking with a joint side of the second combined beam structure, where a staggered pattern formed on the joint side of the first combined beam structure interlocks with the staggered pattern formed on the joint side of the second combined beam structure;

a floor mounted on a foundation, the floor comprising a plurality of floor holes aligned with corresponding bolt bores in the first plurality of beam segments and the second plurality of beam segments, where the bolt segments extend into the floor holes to affix the floor to the first combined beam structure or the second combined beam structure, where the floor comprises the third combined beam structure.

2. The building structure of claim 1 where:

the staggered pattern in each joint side of the first combined beam structure and the second combined beam structure is formed by extending portions of a first subset of the first and second plurality of beam segments disposed in alternating layers with non-extending portions of a second subset of the first and second plurality of the beam segments in each of the first combined beam structure and the second combined beam structure, where the joint sides of the first combined beam structure and the second combined beam structure interlock when the extending portions of the first subset of the first plurality of beam segments on the joint side of the first combined beam structure fit into a space between the extending portions of the first subset of the second plurality of beam segments on the joint side of the second combined beam structure.

3. The building structure of claim 2 where the plurality of bolt bores in each of the plurality of beam segments includes:

a junction bolt bore in a joint end portion of each of the first and second plurality of beam segments, where the joint end portions include either extending or non-extending beam ends at the joint side of each of the first and second composite beam structures; and an inner junction bolt bore disposed an inner junction distance from the junction bolt bore, where the junction bolt bores in extending portions of the first subset of the first plurality of beam segments in the first combined beam structure align with the junction bolt bores in extending portions of the first subset of the second plurality of beam segments in the second combined beam structure, the inner junction bolt bores of the extending portions of the first subset of the first plurality of beam segments in the first combined beam structure align with the junction bolt bores of the non-extending portions of the second subset of the first plurality of beam segments in the first combined beam structure, and the inner junction bolt bores of the extending portions of the first subset of the second plurality of beam segments in the second combined beam structure align with at the junction bolt bores of the non-extending portions of the second subset of the second plurality of beam segments in the second combined beam structure.

4. The building structure of claim 3 where:

the wall structure junction forms a wall corner between the first combined beam structure and the second combined beam structure extending at an angle with the first combined beam structure; and the wall corner of the first combined beam structure and the second combined beam structure is formed such that a planar surface at the beam end of each extending joint end portion of the first combined beam structure is flush with an inner planar surface of a wall structure formed by the second combined beam structure.

5. The building structure of claim 3 where:

the wall structure junction forms a wall corner between the first combined beam structure and the second combined beam structure extending at an angle with the first combined beam structure; and the wall corner of the first combined beam structure and the second combined beam structure is formed such that a planar surface at the beam end of each extending joint end portion of the second combined beam structure is flush with an inner planar surface of a wall structure formed by the first combined beam structure.

6. The building structure of claim 3 where:

the wall structure junction forms a wall corner between the first combined beam structure and the second combined beam structure extending at an angle with the first combined beam structure; and the wall corner of the first combined beam structure and the second combined beam structure is formed such that the joint end portions of the first combined beam structure extend beyond an outer planar surface of a wall structure formed by the second combined beam structure.

7. The building structure of claim 3 where:

the wall structure junction forms a wall corner between the first combined beam structure and the second combined beam structure extending at an angle with the first combined beam structure; and the wall corner of the first combined beam structure and the second combined beam structure is formed such that the joint end portions of the second combined beam structure extend beyond an outer planar surface of a wall structure formed by the first combined beam structure.

8. The building structure of claim 1 where the wall structure junction forms a wall corner between the first combined beam structure and the second combined beam structure extending at an angle with the first combined beam structure.

9. The building structure of claim 8 where the wall corner of the first combined beam structure and the second combined beam structure forms a substantially 90-degree angle.

10. The building structure of claim 1 where the foundation is a gravel surface.

11. The building structure of claim 1 where the foundation comprises:

at least one post extending from a ground surface; and a bracket configured to attach to the at least one post and to the floor.

12. The building structure of claim 1 where the first, second and third plurality of beam segments are is formed of materials selected from a group of materials consisting of natural wood, cedar, redwood, wood composites, and synthetic materials.

13. The building structure of claim 1 further comprising:

a layer of adhesive on each top surface in contact with the bottom surface of the next one of each of the plurality of beam segments.

14. The building structure of claim 1, where the first combined beam structure forms a first wall, and the second combined beam structure forms a second wall, the building structure further comprising:

at least one additional combined beam structure comprising another plurality of beam segments configured to form at least one additional wall, the at least one additional wall configured to form at least one additional wall structure junction with the first wall, the second wall or another wall, where the first wall, the second wall, and the at least one additional wall combine to form an enclosed interior;

a roof extending at least over at least part of the enclosed interior;

wherein an access gap is provided at a top of each of the first wall, the second wall and the at least one additional wall and around one or more tightening fasteners such that after construction, each of the one or more tightening fasteners are accessible from an interior side of an uppermost one of the plurality of beam segments on each of the first wall, the second wall and the at least one additional wall to adjust a pressure applied by the tightening fasteners.

15. The building structure of claim 14 wherein access to the interior is provided by utilizing truncated beams in selected locations and layers in the first, second and at least one additional walls to facilitate openings for doors and windows.

16. The building structure of claim 1 where the plurality of tightening fasteners includes a plurality of nuts and washers configured to screw on the bolt segments.

17. A building structure comprising:

a first combined beam structure and a second combined beam structure each comprising a plurality of beam segments including a first beam segment and a last beam segment, each of the plurality of beam segments having a rectangular cross-section including a planar top surface and a planar bottom surface extending between a pair of beam ends, and arranged with at least most of the top surface of each of the plurality of beam segments in direct contact with at least most of the bottom surface of a next one of the plurality of beam segments between the first beam segment and the last beam segment, where each beam segment includes a plurality of bolt bores extending between the top and bottom surfaces in substantial alignment through each of the plurality of beam segments, where the bolt bores are formed in a spaced apart arrangement and configured to receive a corresponding plurality of bolt segments configured to receive a plurality of tightening fasteners for applying compression between the first beam segment and the last beam segment;

where the plurality of beam segments in each of the first and second combined beam structures are made of a material that is compressible to form an integrated structure when the tightening fasteners are tightened;

a wall structure junction between the first combined beam structure and the second combined beam structure formed by a joint side of the first combined beam structure interlocking with the joint side of the second combined beam structure, where a staggered pattern formed on the joint side of the first combined beam structure interlocks with the staggered pattern formed on the joint side of the second combined beam structure;

where the first combined beam structure forms a first wall, and the second combined beam structure forms a second wall;

at least one additional combined beam structure comprising another plurality of beam segments configured to form at least one additional wall configured to form at least one additional wall structure junction with the first wall, the second wall or another wall, where the first wall, the second wall, and the at least one additional wall combine to form an enclosed interior; and a roof extending at least over all of the enclosed interior;

where an access gap is provided at a top of each of the first wall, the second wall and the at least one additional wall and around one or more tightening fasteners such that after construction, each of the one or more tightening fasteners are accessible from an interior side of an uppermost one of the plurality of beam segments on each of the first wall, the second wall and the at least one additional wall to adjust a pressure applied by the tightening fasteners.

18. The building structure of claim 17 where:

access to the interior is provided by utilizing truncated beams in selected locations and layers in the first, second and at least one additional walls to facilitate openings for doors and windows.

19. The building structure of claim 17 where:

the staggered pattern in each joint side of the first combined beam structure and the second combined beam structure is formed by extending portions of a first subset of the first and second plurality of beam segments disposed in alternating layers with non-extending portions of a second subset of the first and second plurality of the beam segments in each of the first combined beam structure and the second combined beam structure, where the joint sides of the first combined beam structure and the second combined beam structure interlock when the extending portions of the first subset of the first plurality of beam segments on the joint side of the first combined beam structure fit into a space between the extending portions of the first subset of the second plurality of beam segments on the joint side of the second combined beam structure.

20. The building structure of claim 19 where the plurality of bolt bores in each of the plurality of beam segments includes:

a junction bolt bore in a joint end portion of each of the first and second plurality of beam segments, where the joint end portions include either extending or non-extending beam ends at the joint side of each of the first and second composite beam structures; and an inner junction bolt bore disposed an inner junction distance from the junction bolt bore, where the junction bolt bores in extending portions of the first subset of the first plurality of beam segments in the first combined beam structure align with the junction bolt bores in extending portions of the first subset of the second plurality of beam segments in the second combined beam structure, the inner junction bolt bores of the extending portions of the first subset of the first plurality of beam segments in the first combined beam structure align with the junction bolt bores of the non-extending portions of the second subset of the first plurality of beam segments in the first combined beam structure, and the inner junction bolt bores of the extending portions of the first subset of the second plurality of beam segments in the second combined beam structure align with at the junction bolt bores of the non-extending portions of the second subset of the second plurality of beam segments in the second combined beam structure.

21. The building structure of claim 20 where:

the wall structure junction forms a wall corner between the first combined beam structure and the second combined beam structure extending at an angle with the first combined beam structure; and the wall corner of the first combined beam structure and the second combined beam structure is formed such that a planar surface at the beam end of each extending joint end portion of the first combined beam structure is flush with an inner planar surface of a wall structure formed by the second combined beam structure.

22. The building structure of claim 20 where:

the wall structure junction forms a wall corner between the first combined beam structure and the second combined beam structure extending at an angle with the first combined beam structure; and the wall corner of the first combined beam structure and the second combined beam structure is formed such that a planar surface at the beam end of each extending joint end portion of the second combined beam structure is flush with an inner planar surface of a wall structure formed by the first combined beam structure.

23. The building structure of claim 20 where:

the wall structure junction forms a wall corner between the first combined beam structure and the second combined beam structure extending at an angle with the first combined beam structure; and the wall corner of the first combined beam structure and the second combined beam structure is formed such that the joint end portions of the first combined beam structure extend beyond an outer planar surface of a wall structure formed by the second combined beam structure.

24. The building structure of claim 20 where:

the wall structure junction forms a wall corner between the first combined beam structure and the second combined beam structure extending at an angle with the first combined beam structure; and the wall corner of the first combined beam structure and the second combined beam structure is formed such that the joint end portions of the second combined beam structure extend beyond an outer planar surface of a wall structure formed by the first combined beam structure.

25. The building structure of claim 17 where the wall structure junction forms a wall corner between the first combined beam structure and the second combined beam structure extending at an angle with the first combined beam structure.

26. The building structure of claim 25 where the wall corner of the first combined beam structure and the second combined beam structure forms a substantially 90-degree angle.

27. The building structure of claim 17 where each beam segment in each of the plurality of beam segments in each of the first combined beam structure, the second combined beam structure, and the at least one additional combined beam structure is formed of materials selected from a group of materials consisting of natural wood, cedar, redwood, wood composites, and synthetic materials.

28. The building structure of claim 17 further comprising:

a layer of adhesive on each top surface in contact with the bottom surface of the next one of each of the plurality of beam segments in each of the first combined beam structure, the second combined beam structure, and the at least one additional combined beam structure.

29. The building structure of claim 17 further comprising:

a floor mounted on a foundation, the floor comprising a plurality of floor holes aligned with corresponding bolt bores in the plurality of beam segments in the first combined beam structure or the second combined beam structure, where the bolt segments extend into the floor holes to affix the floor to the first combined beam structure or the second combined beam structure.

30. The building structure of claim 29 where:

the floor includes an other plurality of beam segments arranged with a top surface of each beam segment in the other plurality of beam segment substantially in contact with a bottom surface of a next one of the other plurality of beam segments between a first one of the other plurality of beam segments and a last one of the other plurality of beam segments, where each of the other plurality of beam segments includes a plurality of bolt bores extending between the top and bottom surfaces of each one of the other plurality of beam segments in substantial alignment through each of the other plurality of beam segments, where the bolt bores are formed in a spaced apart arrangement and configured to receive a corresponding plurality of bolt segments configured to receive a plurality of tightening fasteners for applying compression between the first one of the other plurality beam segments and the last one of the other plurality of beam segments, where the other plurality of beam segments is disposed horizontally forming the floor.

* * * * *